US008725224B2

(12) United States Patent
Sato et al.

(10) Patent No.: US 8,725,224 B2
(45) Date of Patent: May 13, 2014

(54) SUPERCONDUCTING FILTER WITH DISK-SHAPED ELECTRODE PATTERN

(75) Inventors: Keisuke Sato, Kawasaki (JP); Teru Nakanishi, Kawasaki (JP); Akihiko Akasegawa, Kawasaki (JP); Kazunori Yamanaka, Kawasaki (JP); Kazuaki Kurihara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 486 days.

(21) Appl. No.: 12/498,456

(22) Filed: Jul. 7, 2009

(65) Prior Publication Data

US 2010/0009854 A1 Jan. 14, 2010

(30) Foreign Application Priority Data

Jul. 8, 2008 (JP) ..... 2008-178100

(51) Int. Cl.
*H01P 1/203* (2006.01)
*H01B 12/02* (2006.01)

(52) U.S. Cl.
CPC ..... *H01B 12/02* (2013.01); *H01P 1/203* (2013.01)
USPC ..... 505/210; 333/99 S; 333/204

(58) Field of Classification Search
USPC ..... 333/204, 219, 99 S; 505/210
See application file for complete search history.

(56) References Cited

U.S. PATENT DOCUMENTS

| | | | | |
|---|---|---|---|---|
| 5,750,473 | A * | 5/1998 | Shen | 505/210 |
| 7,734,319 | B2 * | 6/2010 | Akasegawa | 505/210 |
| 2004/0209581 | A1 | 10/2004 | Mizoguchi et al. | |
| 2007/0229197 | A1 * | 10/2007 | Okano | 333/219 |

FOREIGN PATENT DOCUMENTS

| | | | |
|---|---|---|---|
| JP | 52-000152 | A | 1/1977 |
| JP | 7-336105 | A | 12/1995 |
| JP | 2000-511375 | A | 8/2000 |
| JP | 2004-320351 | A | 11/2004 |
| JP | 2008-028835 | A | 2/2008 |
| WO | 97/44852 | A1 | 11/1997 |
| WO | 2006/075498 | A1 | 7/2006 |

* cited by examiner

*Primary Examiner* — Benny Lee
(74) *Attorney, Agent, or Firm* — Westerman, Hattori, Daniels & Adrian, LLP

(57) ABSTRACT

A filter includes a dielectric substrate; an electrode layer continuously formed covering a first side of the dielectric substrate; a disk-shaped electrode pattern provided on a second side of the dielectric substrate, the disk-shaped electrode pattern and the electrode layer holding the dielectric substrate therebetween; a ground slot having an opening that is formed asymmetrically with respect to the center of a circular area included in the electrode layer and exposes the dielectric substrate, the circular area and the disk-shaped electrode pattern holding the dielectric substrate therebetween.

7 Claims, 23 Drawing Sheets

SUPERCONDUCTING FILTER WITH DISK-SHAPED ELECTRODE PATTERN

CROSS-REFERENCE TO RELATED APPLICATIONS

This application is based upon and claims the benefit of priority of the prior Japanese Patent Application No. 2008-178100, filed on Jul. 8, 2008 the entire contents of which are incorporated herein by reference.

FIELD

The present invention relates to filters, and more particularly to a filter that has a disk-shaped electrode pattern.

BACKGROUND

Filters that include a microstrip line using a superconducting film are low-loss filters and are expected to be applied to GHz-band high-power transmission apparatuses such as base stations for mobile communication.

However, the superconductivity of a superconducting film tends to deteriorate when power applied to the superconducting film is high; thus it has been difficult to apply such a superconducting film in high-power applications.

For this problem, a filter that uses a disk-shaped electrode pattern and prevents power to be applied to the filter from being high has been proposed.

Moreover, in order to obtain a steep filter characteristic, a technology has been proposed in which a multiple-stage filter is configured by arranging a plurality of resonators, each of which is provided with a disk-shaped electrode pattern, on a dielectric substrate and by coupling the resonators.

FIG. 1 presents a schematic structure of a superconducting tunable filter 10 disclosed in Japanese Laid-open Patent Publication No. 2008-28835.

Referring to FIG. 1, the superconducting tunable filter 10 is formed on a dielectric substrate 11. The superconducting tunable filter 10 includes a superconducting ground layer 12 that covers the back-side surface of the dielectric substrate 11, superconducting disk-shaped electrode patterns 13A, 13B, 13C, and 13D that are formed on the front-side surface of the dielectric substrate 11, a superconducting input-side feeder pattern 14A that is coupled to the superconducting disk-shaped electrode pattern 13A, a superconducting output-side feeder pattern 14E that is coupled to the superconducting disk-shaped electrode pattern 13D, a superconducting feeder pattern 14B that is used to couple the superconducting disk-shaped electrode pattern 13A to the superconducting disk-shaped electrode pattern 13B, a superconducting feeder pattern 14C that is used to couple the superconducting disk-shaped electrode pattern 13B to the superconducting disk-shaped electrode pattern 13C, and a superconducting feeder pattern 14D that is used to couple the superconducting disk-shaped electrode pattern 13C to the superconducting disk-shaped electrode pattern 13D. A dielectric plate 15 is provided apart from the front-side surface of the dielectric substrate 11 in such a manner that the dielectric plate 15 may be adjusted to be closer to or further away from the front-side surface of the dielectric substrate 11. The dielectric plate 15 enables adjustment of the center frequency of the superconducting tunable filter 10.

In the superconducting tunable filter 10 configured like this, the superconducting disk-shaped electrode patterns 13A to 13D prevent the intensity of an electric field from being high. Thus, the superconducting tunable filter 10 may be applied to high-power applications.

Moreover, holes 15A, 15B, 15C, 15D and 15E to that allow adjustment rods composed of a dielectric or magnetic material to pass therethrough are formed in the dielectric plate 15. Although not presented, adjustment rods composed of a magnetic or dielectric material are formed in such a manner that the adjustment rods may be adjusted to be closer to or further away from the superconducting disk-shaped electrode patterns 13A to 13D and the superconducting feeder patterns 14B and 14D through the holes 15A to 15E. With this structure, the bandwidth of the superconducting tunable filter 10 may be adjusted using the adjustment rods.

In the superconducting tunable filter 10 presented in FIG. 1, which is a related art superconducting tunable filter, the dielectric plate 15 is coupled not only to the superconducting disk-shaped electrode patterns 13A to 13D but also to the superconducting input-side and output-side feeder patterns 14A and 14E and the superconducting feeder patterns 14B to 14D. Thus, if the center frequency of the superconducting tunable filter 10 is adjusted by moving the dielectric plate 15 closer to or further away from the front-side surface of the dielectric substrate 11, coupling states of the superconducting input-side and output-side feeder patterns 14A and 14E and the superconducting feeder patterns 14B to 14D and the superconducting disk-shaped electrode patterns 13A to 13D also change. As a result, for the superconducting tunable filter 10 presented in FIG. 1, there is a problem in that adjustment of filter characteristics such as the center frequency and the bandwidth becomes complicated. Moreover, in the superconducting tunable filter 10 disclosed in FIG. 1, for example, the superconducting input-side and output-side feeder patterns 14A and 14E are coupled to curved peripheries of the superconducting disk-shaped electrode patterns 13A and 13D, respectively, from the outside. Thus, the area of a connecting portion, that is, the capacitance of the connecting portion is small, and it is difficult to ensure an appropriate connection. The same problem exists for the superconducting feeder patterns 14B to 14D. Thus, for the superconducting tunable filter 10 disclosed in FIG. 1, significantly suppressing loss is difficult.

SUMMARY OF THE INVENTION

According to one aspect of the invention, a filter includes a dielectric substrate; an electrode layer continuously formed covering a first side of the dielectric substrate; a disk-shaped electrode pattern provided on a second side of the dielectric substrate, the disk-shaped electrode pattern, and the electrode layer holding the dielectric substrate therebetween; a ground slot having an opening that is formed asymmetrically with respect to the center of a circular area included in the electrode layer and exposes the dielectric substrate, the circular area, and the disk-shaped electrode pattern holding the dielectric substrate therebetween.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

First Embodiment

Figure 1:
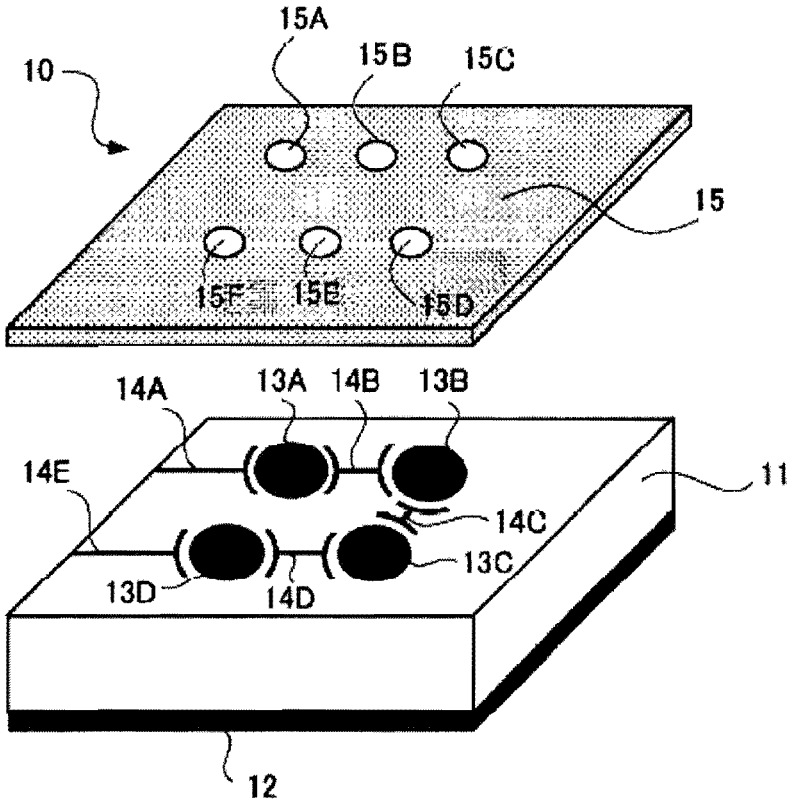
FIG. 1 RELATED ART
FIG. 1 is a diagram of a related art superconducting filter.
Figure 2A:
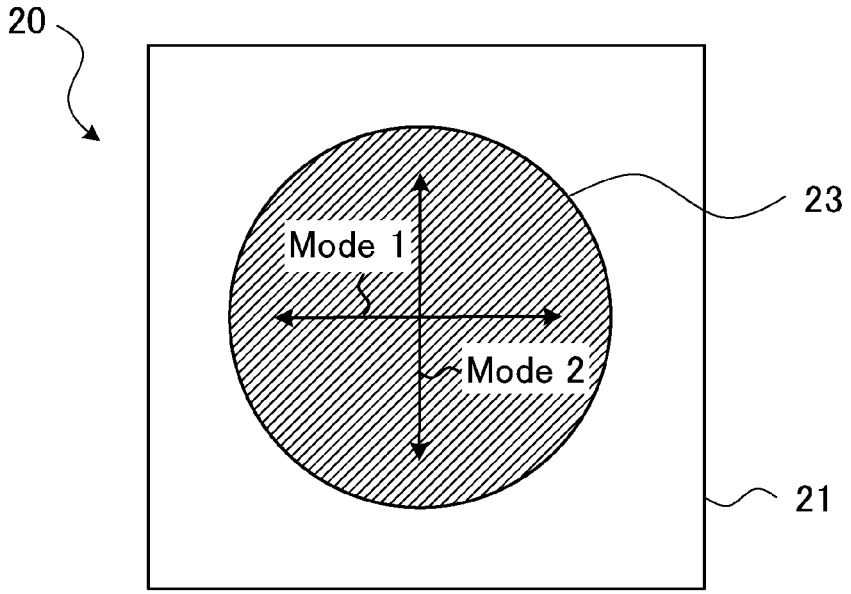
FIG. 2A is a plan view of a superconducting resonator according to a first embodiment.
Figure 2B:
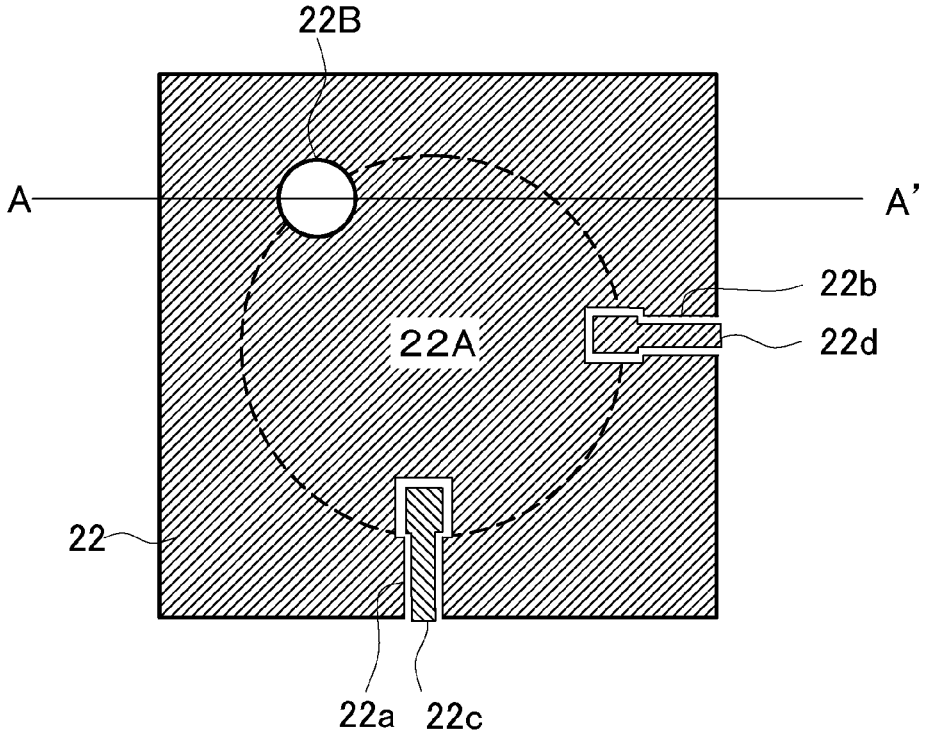
FIG. 2B is a bottom view of the superconducting resonator according to the first embodiment.
Figure 2C:
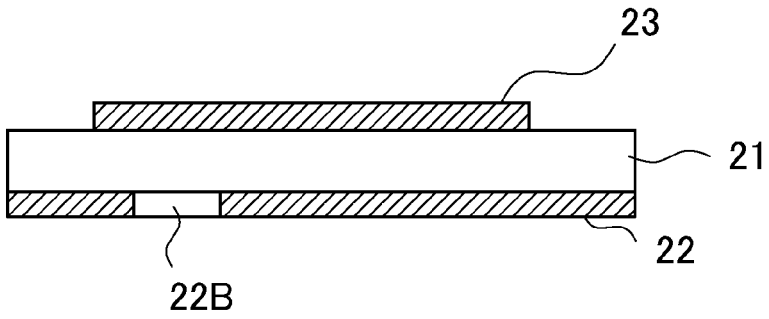
FIG. 2C is a sectional view of the superconducting resonator according to the first embodiment, the sectional view being taken along line A-A' in FIG. 2B.

FIGS. 2A to 2C are a plan view, a bottom view, and a sectional view taken along line A-A' in FIG. 2B, respectively, of a structure of a superconducting dual-mode resonator 20 according to a first embodiment.

Referring to FIGS. 2A to 2C, as seen in FIGS. 2A and 2C, the superconducting dual-mode resonator 20 is formed on a low-loss dielectric substrate 21 having a thickness of, for example, 0.5 mm and composed of MgO or the like. Per FIGS. 2B and 2C, an electrode layer 22 having a thickness of, for example, 0.5 μm and composed of, for example, a YBCO (Y—Ba—Cu—O) high-temperature superconductor is uniformly formed on the bottom surface of the low-loss dielectric substrate 21. Moreover, per FIGS. 2A and 2C, a disk-shaped electrode pattern 23 composed of the same high-temperature superconductor as described above and having, for example, a thickness of 0.5 μm and a radius of 5.6 mm is formed on the top surface of the low-loss dielectric substrate 21.

Per FIGS. 2B and 2C, a circular opening 22B having, for example, a radius of 1 mm is formed in the electrode layer 22 at a position away from the center of a circular area 22A in such a manner that the circular opening 22B exposes the bottom surface of the low-loss dielectric substrate 21. Per FIGS. 2B and 2C, the circular area 22A and the disk-shaped electrode pattern 23 has the low-loss dielectric substrate 21 therebetween. Furthermore, a first feeder cutout portion 22*a* is formed in the electrode layer 22 in such a manner that the first feeder cutout portion 22*a* reaches the circular area 22A from part of the periphery of the low-loss dielectric substrate 21 and exposes the bottom surface of the low-loss dielectric substrate 21. Moreover, a second feeder cutout portion 22*b* is formed in the electrode layer 22 in such a manner that the second feeder cutout portion 22*b* reaches the circular area 22A from part of the periphery of the low-loss dielectric substrate 21. The second feeder cutout portion 22*b* also exposes the bottom surface of the low-loss dielectric substrate 21, and is formed perpendicular to the first feeder cutout portion 22*a*.

Furthermore, per FIGS. 2B and 2C, an input-side conductive pattern 22*c* composed of the same superconductor as described above is formed in the first feeder cutout portion 22*a*, and the first feeder cutout portion 22*a* and the input-side conductive pattern 22*c* form an input-side coplanar-type feeder line (hereinafter referred to as an "input-side feeder line"). Similarly, an output-side conductive pattern 22*d* composed of the same superconductor as described above is formed in the second feeder cutout portion 22*b*. Similarly, the second feeder cutout portion 22*b* and the output-side conductive pattern 22*d* form an output-side coplanar-type feeder line (hereinafter referred to as an "output-side feeder line").

An electric field component of an input signal supplied from the input-side conductive pattern 22*c* vibrates in the direction indicated by Mode 1 in FIG. 2A in the superconducting dual-mode resonator 20. In contrast, an electric field component of an output signal output to the output-side conductive pattern 22*d* vibrates in the direction indicated by Mode 2 in FIG. 2A in the superconducting dual-mode resonator 20. A ground slot 22B formed in the electrode layer 22 functions so as to couple these two modes together.

Figure 3:
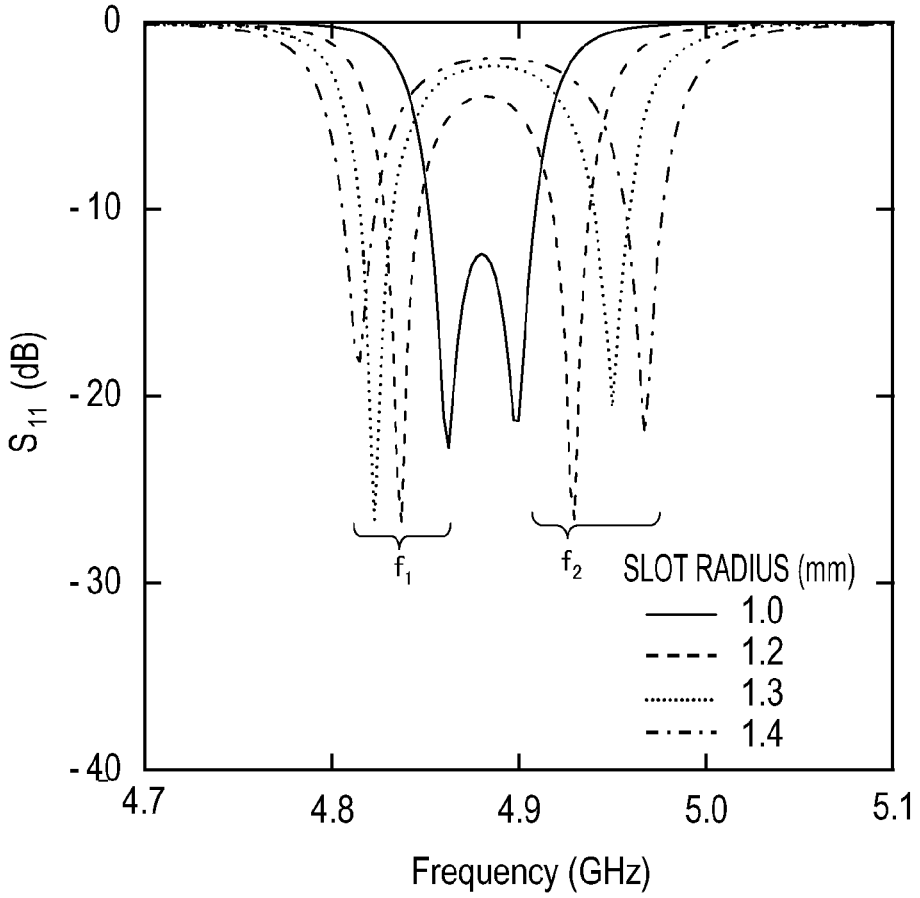
FIG. 3 is a diagram illustrating a reflection characteristic of the superconducting resonator illustrated in FIGS. 2A to 2C.

FIG. 3 illustrates reflection characteristics ($S_{11}$ parameters in dB) vs. Frequency in GHz obtained at a temperature of 70 K of the superconducting dual-mode resonator 20 illustrated in FIGS. 2A to 2C. As is well known in the art, the $S_{11}$ parameter indicates a reflection characteristic of a filter from the viewpoint of the input side. Here, FIG. 3 illustrates cases where the radii of the ground slot 22B are 1.0 mm, 1.2 mm, 1.3 mm, and 1.4 mm.

Referring to FIG. 3, peaks having resonance frequencies $f_1$, and $f_2$ appear in the reflection characteristic graph at the low-frequency side and at the high-frequency side, respectively. FIG. 3 illustrates that the gap between the resonance frequencies $f_1$ and $f_2$ increases as the radius of the ground slot 22B increases. This indicates that the degree of coupling between the modes performed by the ground slot 22B increases as the radius of the ground slot 22B increases.

Figure 4:
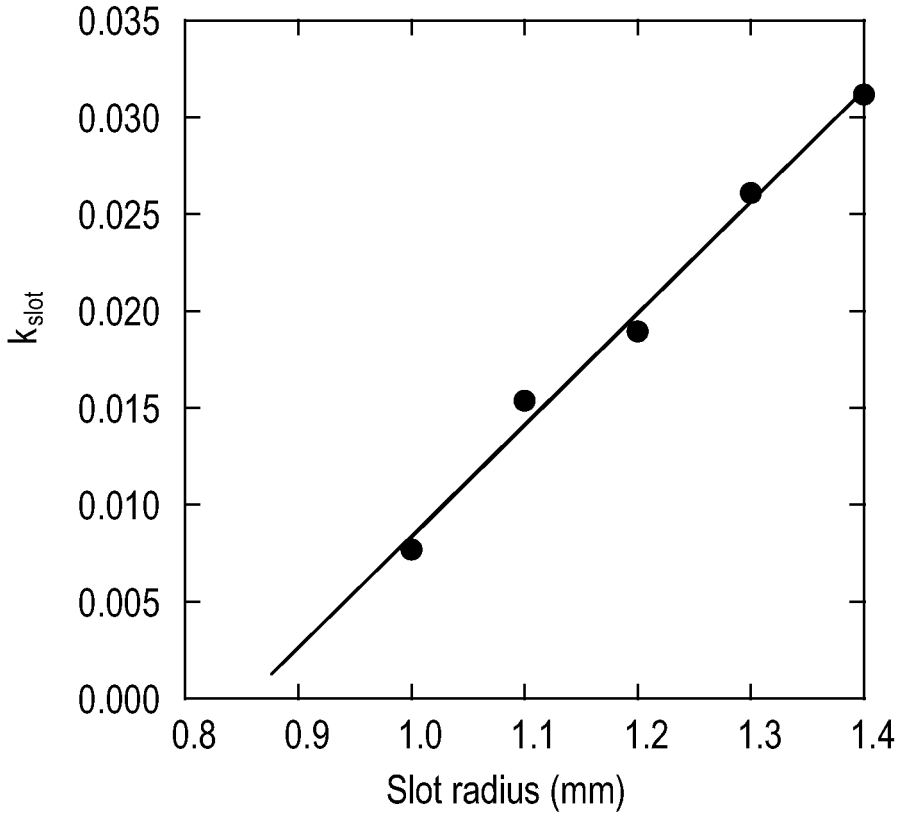
FIG. 4 is a diagram of an inter-mode coupling coefficient of the superconducting resonator illustrated in FIGS. 2A to 2C.

FIG. 4 illustrates a relationship between a coupling coefficient $k_{slot}$ used for coupling the modes (hereinafter referred to as an inter-mode coupling coefficient $k_{slot}$) and the radius in mm of the ground slot 22B, the coupling coefficient $k_{slot}$ being obtained from the reflection characteristic in FIG. 3. Here, the inter-mode coupling coefficient $k_{slot}$ is expressed by the expression $$k_{slot}=(f_{22}-f_{12})/(f_{22}+f_{12})(f_2>f_1).$$

Referring to FIG. 4, the relationship established between the radius of the ground slot 22B and the inter-mode coupling coefficient $k_{slot}$ is almost linear. Here, a case where the radius of the slot illustrated in FIG. 4 is 1.1 mm is not depicted in FIG. 3 in order to prevent FIG. 3 from becoming complicated.

In the first embodiment, the input-side feeder line including the first feeder cutout portion 22*a* and the input-side conductive pattern 22*c* and the output-side feeder line including the second feeder cutout portion 22*b* and the output-side conductive pattern 22*d* are formed in such a manner that they reach the circular area 22A within the electrode layer 22 continuously formed on the back-side surface of the low-loss dielectric substrate 21. As a result, according to the present invention, strong coupling may be achieved between the input-side conductive pattern 22*c* and the electrode layer 22 and between the output-side conductive pattern 22*d* and the electrode layer 22. That is, according to the first embodiment, loss caused by using the superconducting dual-mode resonator 20 or loss caused by using a filter using the superconducting dual-mode resonator 20 may be more significantly reduced than when feeder lines are formed on the front-side surface of the low-loss dielectric substrate 21.

Here, in the first embodiment, the low-loss dielectric substrate 21 is not limited to an MgO single crystal substrate and may alternatively be a $LaAlO_3$ single crystal substrate or a sapphire substrate.

Furthermore, the electrode layer 22, the disk-shaped electrode pattern 23, and the input-side and output-side conductive patterns 22*c* and 22*d* are not limited to those composed of the YBCO high-temperature superconductor and may alternatively be composed of, for example, an R—Ba—Cu—O (RBCO) high-temperature superconductor film, that is, a film composed of neodymium (Nd), samarium (Sm), gadolinium (Gd), dysprosium (Dy), or holmium (Ho) instead of yttrium (Y) in the YBCO high-temperature superconductor.

Furthermore, Ba—Sr—Ca—Cu—O (BSCCO), Pb—Bi—Sr—Ca—Cu—O (PBSCCO), and Cu—$Ba_p$—$Ca_q$—$Cu_r$—Ox (CBCCO) (where $1.5<p<2.5$, $2.5<q<3.5$, $3.5<r<4.5$) high-temperature superconductors may alternatively be used in the first embodiment.

In the first embodiment, the intensity of an electric field may be prevented from becoming high and the problem of the electrode layer 22 losing its superconductivity because of an intense electric field may be reduced if not prevented from occurring by forming the ground slot 22B in a circular shape.

Here, in the superconducting dual-mode resonator 20 according to the first embodiment, the electrode layer 22, the disk-shaped electrode pattern 23, the input-side conductive pattern 22*c*, and the output-side conductive pattern 22*d* are not necessarily composed of a high-temperature superconductor, and may alternatively be composed of a normal conductor.

The superconducting dual-mode resonator 20 according to the first embodiment may be used as a GHz-band filter.

Second Embodiment

Figure 5:
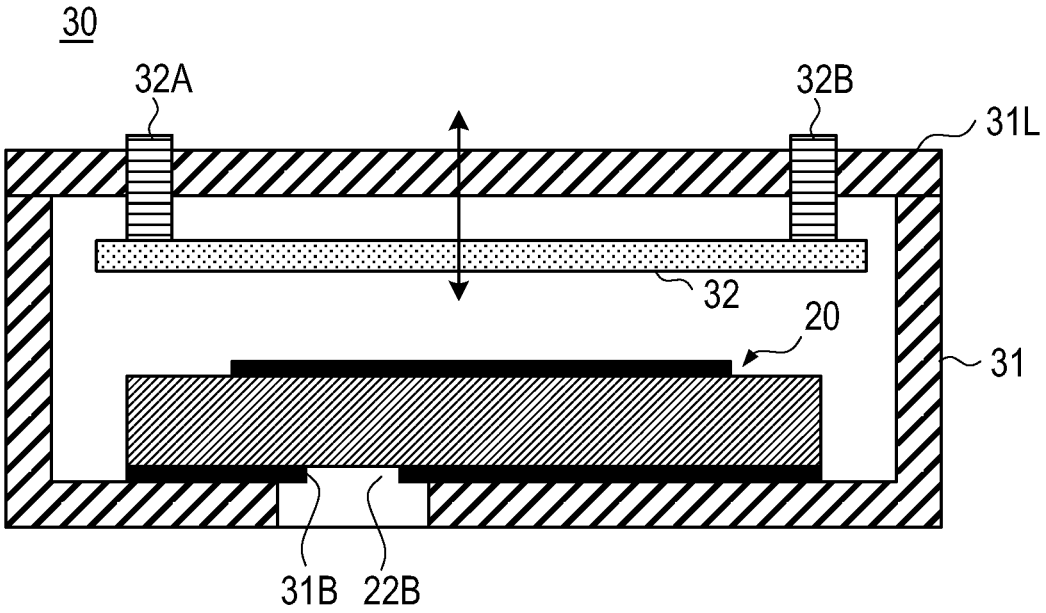
FIG. 5 is a sectional view of a superconducting filter according to a second embodiment.

FIG. 5 illustrates a superconducting filter 30 according to a second embodiment using the superconducting dual-mode resonator 20.

Referring to FIG. 5, the superconducting filter 30 includes a package container 31 that carries a wiring pattern (not shown) formed as a microstrip line on the bottom portion of the superconducting filter 30. The superconducting dual-mode resonator 20 may be mounted on the bottom portion of the package container 31 by a flip-chip method. Moreover, an opening 31B corresponding to the ground slot 22B is formed in the bottom portion of the package container 31.

Furthermore, a dielectric plate 32 composed of MgO, sapphire, or the like is arranged above the superconducting dual-mode resonator 20 in the package container 31. The dielectric plate 32 is held by a cover 31L of the package container 31 using screws 32A and 32B and the like in such a manner that the dielectric plate 32 may be adjusted to be closer to or further away from the superconducting dual-mode resonator 20. The distance between the dielectric plate 32 and the superconducting dual-mode resonator 20 may be adjusted to be in the range of 0.01 mm to 10 mm.

Figure 6:
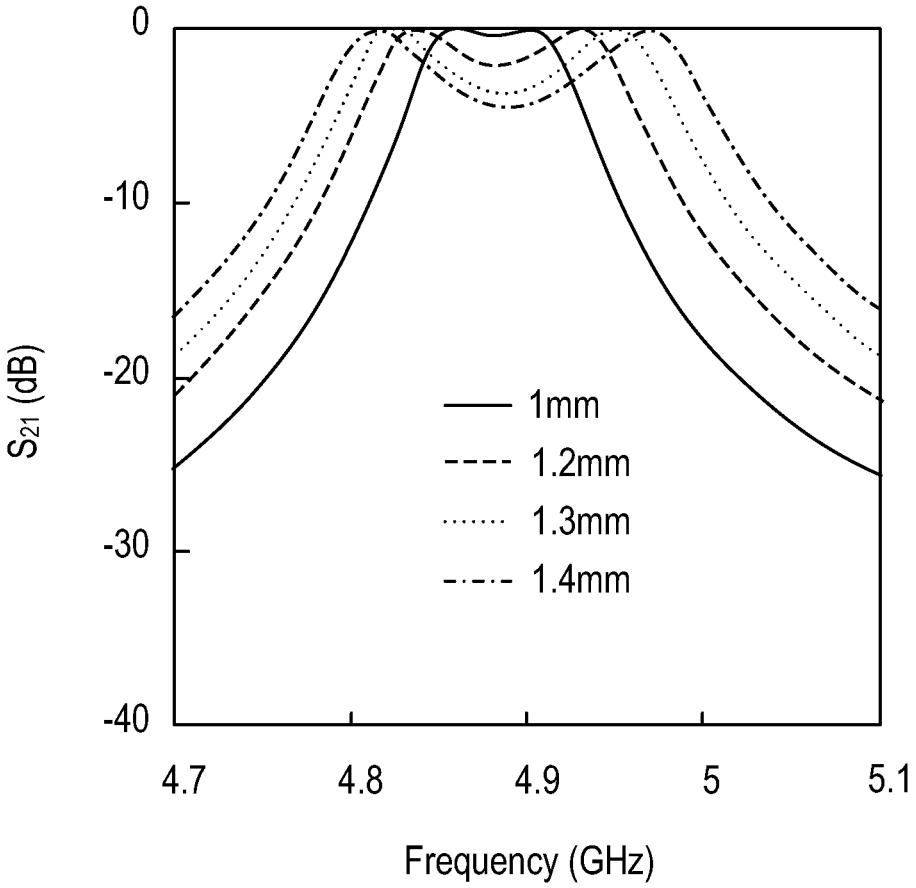
FIG. 6 is a diagram of a transmission characteristic of the superconducting filter illustrated in FIG. 5.

FIG. 6 illustrates a transmission characteristic of the superconducting filter 30, the transmission characteristic being obtained at a temperature of 60 K with $S_{21}$(dB) in the y-axis and Frequency (GHz) in the x-axis.

Referring to FIG. 6, the transmission characteristic corresponds to the reflection characteristic in FIG. 3. FIG. 6 depicts Frequency (GHz) in the x-axis plotted to transmission characteristic $S_{21}$ (dB) in the y-axis. FIG. 6 shows that the passband width of the superconducting filter 30 may be freely set by setting the size of the ground slot 22B, 1.0 mm, 1.2 mm, 1.3 mm, and 1.4 mm in FIG. 6, without the center frequency of the superconducting filter 30 being substantially changed.

Furthermore, in the superconducting filter 30 illustrated in FIG. 5, the center frequency of the superconducting filter 30 may be changed by adjusting the distance between the superconducting dual-mode resonator 20 and the dielectric plate 32 using the screws 32A and 32B, without the passband width illustrated in the transmission characteristic in FIG. 6 being substantially changed. The center frequency of the superconducting filter 30 increases as the dielectric plate 32 is adjusted to be closer to the superconducting dual-mode resonator 20, and the center frequency thereof decreases as the dielectric plate 32 is adjusted to be further away from the superconducting dual-mode resonator 20.

The dielectric plate 32 and the screws 32A and 32B may be omitted in the superconducting filter 30 in FIG. 5.

In the second embodiment, as described above, the input-side feeder line including the first feeder cutout portion 22*a* and the input-side conductive pattern 22*c* and the output-side feeder line including the second feeder cutout portion 22*b* and the output-side conductive pattern 22*d* are formed in such a manner that they reach the circular area 22A within the electrode layer 22 continuously formed on the back-side surface of the low-loss dielectric substrate 21. As a result, according to the present invention, strong coupling may be achieved between the input-side conductive pattern 22*c* and the electrode layer 22 and between the output-side conductive pattern 22*d* and the electrode layer 22. That is, according to the second embodiment, loss caused by using the superconducting dual-mode resonator 20 or loss caused by using a filter using the superconducting dual-mode resonator 20 may be more significantly reduced than the case in which feeder lines are formed on the front-side surface of the low-loss dielectric substrate 21.

Third Embodiment

Figure 7:
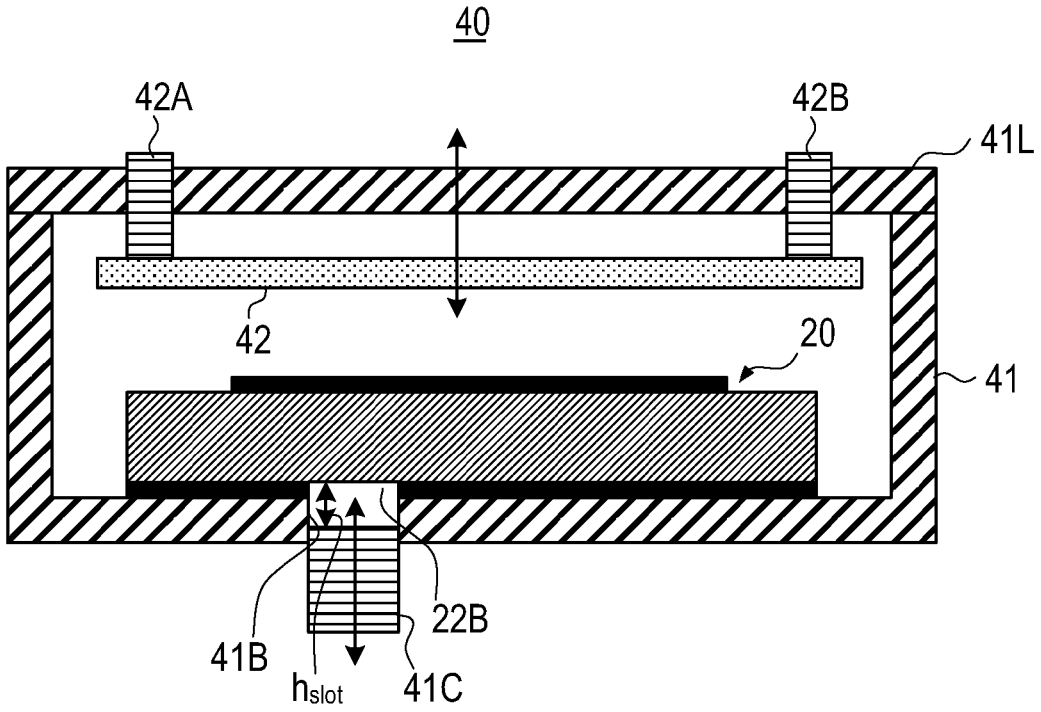
FIG. 7 is a sectional view of a superconducting filter according to a third embodiment.

FIG. 7 illustrates a superconducting filter 40 according to a third embodiment.

Referring to FIG. 7, the superconducting filter 40 includes a package container 41 that carries a wiring pattern (not shown) formed as a microstrip line on the bottom portion of the superconducting filter 40, and the superconducting dual-mode resonator 20 is mounted on the bottom portion of the package container 41 by a flip-chip method. Moreover, an opening 41B corresponding to the ground slot 22B is formed in the bottom portion of the package container 41.

Furthermore, a dielectric plate 42 composed of MgO, sapphire, or the like is arranged above the superconducting dual-mode resonator 20 in the package container 41. The dielectric plate 42 is held by a cover 41L of the package container 41 using screws 42A and 42B and the like in such a manner that the dielectric plate 42 may be adjusted to be closer to or further away from the superconducting dual-mode resonator 20. The distance between the dielectric plate 42 and the superconducting dual-mode resonator 20 may be adjusted to be in the range of 0.01 mm to 10 mm.

Furthermore, a rod 41C corresponding to the ground slot 22B and having a screw shape is formed in the opening 41B of the superconducting filter 40 in such a manner that the rod 41C may be adjusted to be closer to or further away from the low-loss dielectric substrate 21. The distance $h_{slot}$ between the rod 41C and the low-loss dielectric substrate 21 may be adjusted to be in the range of 0.01 mm to 1 mm.

As described above using FIGS. 3 and 4, the passband width of the superconducting dual-mode resonator 20 is controlled by the radius of the ground slot 22B, and the inter-mode coupling coefficient $k_{slot}$ in the superconducting dual-mode resonator 20 is controlled by the radius of the ground slot 22B.

Thus, in the third embodiment, the inter-mode coupling coefficient $k_{slot}$ may be controlled by adjusting the rod 41C to be closer to or further away from the ground slot 22B, whereby the passband characteristic of the superconducting filter 40 is controlled.

Figure 8:
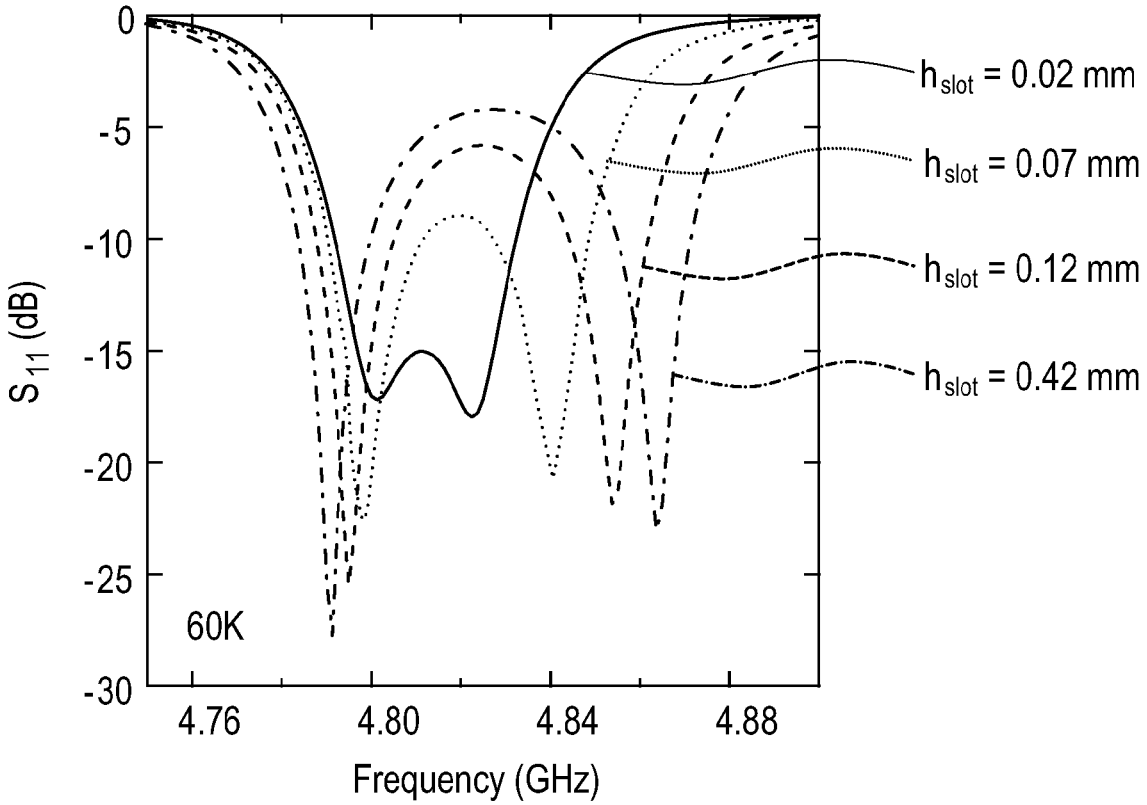
FIG. 8 is a diagram of a reflection characteristic of the superconducting filter illustrated in FIG. 7.
Figure 9:
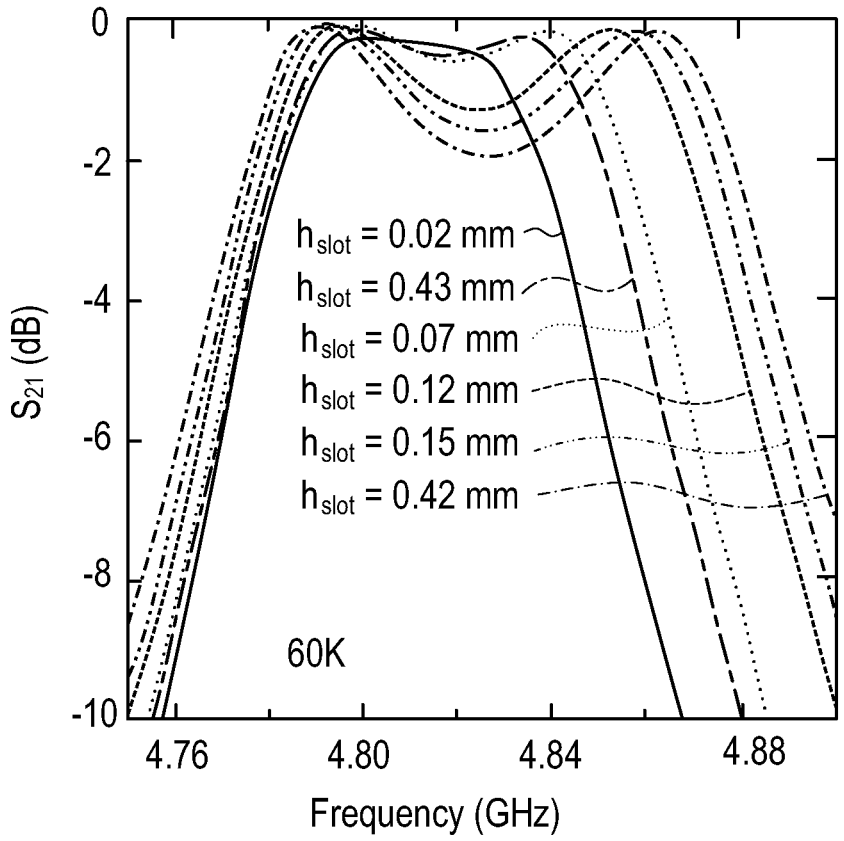
FIG. 9 is a diagram of a reflection characteristic of the superconducting filter illustrated in FIG. 7.

FIG. 8 illustrates a reflection characteristic (S11 in dB) vs. Frequency in GHz of the superconducting filter 40 at a temperature of 60 K, and FIG. 9 illustrates a passband characteristic of the superconducting filter 40 in cases where $h_{slot}$=0.02 mm, $h_{slot}$=0.07 mm, $h_{slot}$=0.12 mm, and $h_{slot}$=0.42 mm. In an example in FIG. 8, a metal screw having a radius of 2 mm is used as the rod 41C. The rod 41C may be composed of a magnetic material or a dielectric material such as MgO, $LaAlO_3$, $TiO_2$, or the like.

As may be seen from FIGS. 8 and 9, the passband width of the superconducting filter 40 decreases as the distance $h_{slot}$ becomes smaller and increases as the distance $h_{slot}$ becomes larger. Moreover, FIGS. 8 and 9 illustrate that if the distance $h_{slot}$ is changed by the rod 41C, the center frequency of the superconducting filter 40 changes. If the distance $h_{slot}$ decreases, the center frequency of the superconducting filter 40 is shifted and becomes lower. If the distance $h_{slot}$ increases, the center frequency of the superconducting filter 40 is shifted and becomes higher. However, such a shift regarding the center frequency of the superconducting filter 40 may be compensated by changing the distance between the dielectric plate 42 and the superconducting dual-mode resonator 20 using the screws 42A and 42B.

Figure 10:
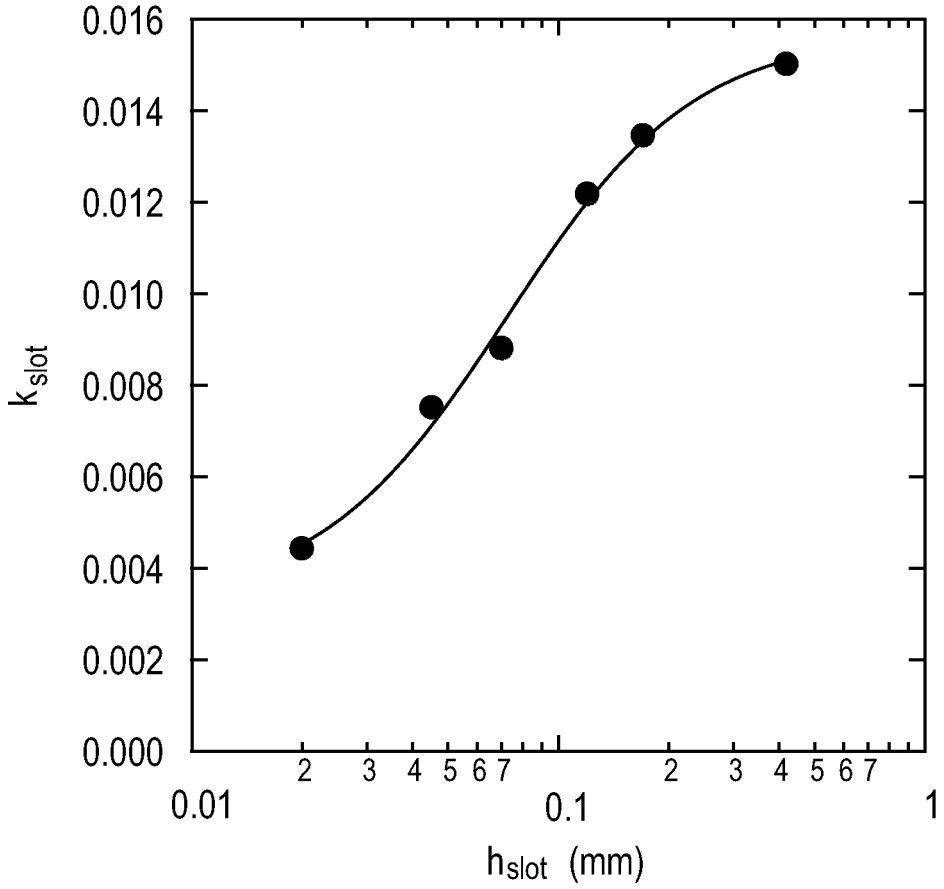
FIG. 10 is a diagram of an inter-mode coupling coefficient of the superconducting filter illustrated in FIG. 7.

FIG. 10 illustrates a relationship between the inter-mode coupling coefficient $k_{slot}$ and the distance $h_{slot}$ in mm for the superconducting filter 40. The inter-mode coupling coefficient $k_{slot}$ is obtained at a temperature of 70 K from the reflection characteristic in FIG. 8.

Referring to FIG. 10, as the distance $h_{slot}$ decreases, the inter-mode coupling coefficient $k_{slot}$ decreases, and the characteristics of the superconducting filter 40 become similar to those of a single-mode filter. As a result, the passband width decreases. In contrast, as the distance $h_{slot}$ increases, the effect of the ground slot 22B increases, whereby the characteristics of the superconducting filter 40 become similar than those of a dual-mode filter. As a result, the passband width increases as illustrated in FIGS. 8 and 9.

The dielectric plate 42 and the screws 42A and 42B may be omitted in the superconducting filter 40 illustrated in FIG. 7.

In the third embodiment, as described above, the input-side feeder line including the first feeder cutout portion 22*a* and the input-side conductive pattern 22*c* and the output-side feeder line including the second feeder cutout portion 22*b* and the output-side conductive pattern 22*d* are formed in such a manner that they reach the circular area 22A within the electrode layer 22 continuously formed on the back-side surface of the low-loss dielectric substrate 21. As a result, according to the present invention, strong coupling may be achieved between the input-side conductive pattern 22*c* and the electrode layer 22 and between the output-side conductive pattern 22*d* and the electrode layer 22. That is, according to the third embodiment, loss caused by using the superconducting filter 40 may be more significantly reduced than the case in which feeder lines are formed on the front-side surface of the low-loss dielectric substrate 21.

Fourth Embodiment

Figure 11A:
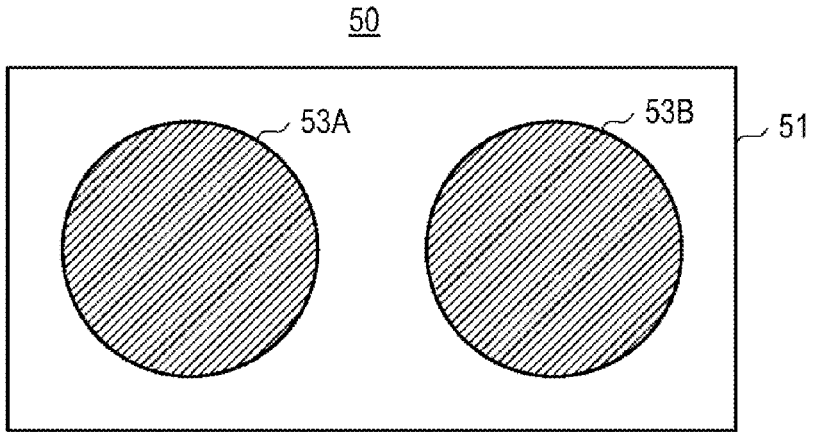
FIG. 11A is a plan view of a superconducting resonator according to a fourth embodiment.
Figure 11B:
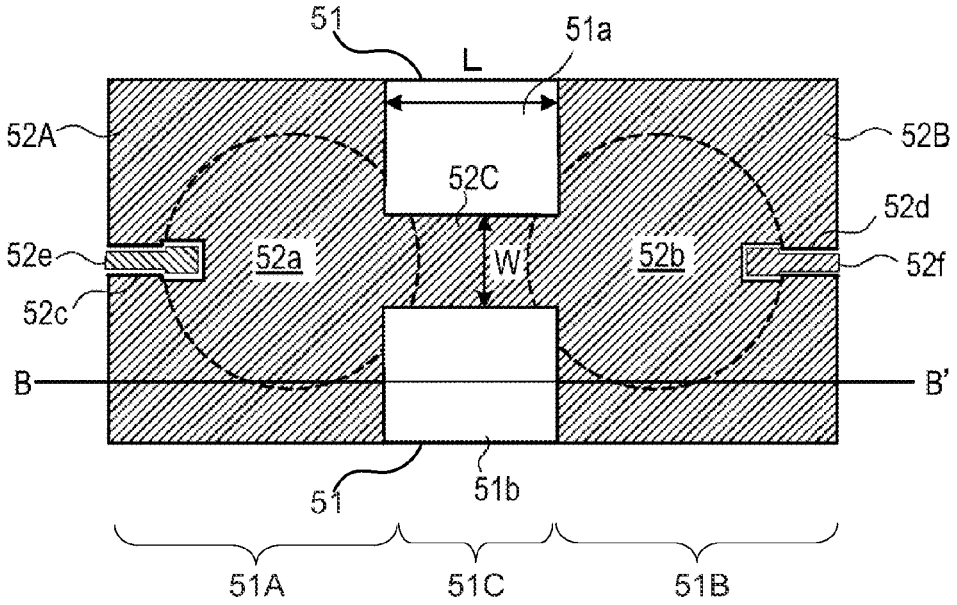
FIG. 11B is a bottom view of the superconducting resonator according to the fourth embodiment.
Figure 11C:
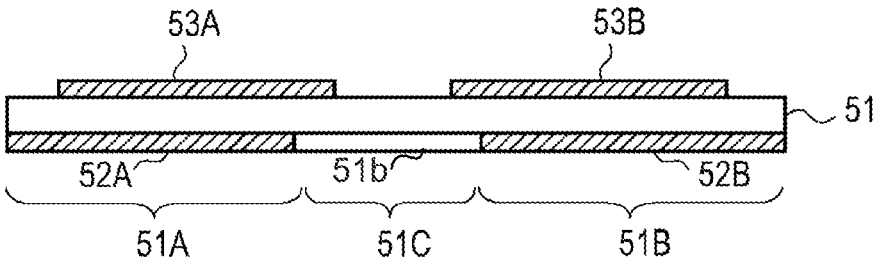
FIG. 11C is a sectional view of the superconducting resonator according to the fourth embodiment, the sectional view being taken along line B-B' in FIG. 11B.

FIGS. 11A to 11C present a structure of a resonator 50 according to a fourth embodiment, FIG. 11A is a plan view, FIG. 11B is a bottom view, and FIG. 11C is a sectional view taken along line B-B' in FIG. 11B.

Referring to FIGS. 11A to 11C, per FIG. 11A, the resonator 50 is formed on a low dielectric substrate 51 per FIGS. 11A & 11C having a thickness of, for example, 0.5 μm and composed of MgO or the like. Per FIGS. 11B and 11C resonator areas 51A and 51B are formed on the low dielectric substrate 51 and spaced apart by a middle area 51C.

Per FIGS. 11B and 11C, an electrode pattern 52A having a thickness of, for example, 0.5 μm and composed of, for example, a YBCO (Y—Ba—Cu—O) high-temperature superconductor is formed on the bottom surface of the low dielectric substrate 51 so as to cover the resonator area 51A per FIGS. 11B and 11C. Furthermore, an electrode pattern 52B composed of a similar high-temperature superconductor is formed on the bottom surface of the low dielectric substrate 51 so as to cover the resonator area 51B per FIGS. 11B and 11C.

Furthermore, the central portions of the electrode patterns 52A and 52B are connected with a connection electrode pattern 52C per FIG. 11B therebetween in the middle area 51C on the bottom surface of the low dielectric substrate 51. The connection electrode pattern 52C is composed of a similar high-temperature superconductor and formed having a width W and a length L. The electrode patterns 52A and 52B and the connection electrode pattern 52C may be formed by forming cutout portions 51*a* per FIGS. 11B and 51*b* in the middle area 51C of a high-temperature conductor film that uniformly covers the bottom surface of the low dielectric substrate 51, the cutout portions 51*a* per FIGS. 11B and 51*b* being formed from sides of the high-temperature conductor film toward a virtual center line connecting the centers of the resonator areas 51A and 51B.

Per FIGS. 11A to 11C, a disk-shaped electrode pattern 53A per FIGS. 11A to 11C composed of the same high-temperature superconductor as described above and having a thickness of, for example, 0.5 μm and a radius of, for example, 5.6 mm is formed on the top surface of the low dielectric substrate 51 in the resonator area 51A in such a manner that the disk-shaped electrode pattern 53A and a circular area 52*a* per FIG. 11B hold the low dielectric substrate 51 therebetween, the circular area 52*a* per FIG. 11B being a part of the electrode pattern 52A. Similarly, FIGS. 11A & 11C, a disk-shaped electrode pattern 53B composed of the same high-temperature superconductor as described above and having a thickness of, for example, 0.5 μm and a radius of, for example, 5.6 mm is formed on the top surface of the low dielectric substrate 51 in the resonator area 51B in such a manner that the disk-shaped electrode pattern 53B and a circular area 52*b* per FIG. 11B hold the low dielectric substrate 51 therebetween, the circular area 52*b* per FIG. 11B being a part of the electrode pattern 52B.

FIG. 11C, a first feeder cutout portion 52*c* is formed in the electrode pattern 52A on the bottom surface of the low dielectric substrate 51 in such a manner that the first feeder cutout portion 52*c* reaches the circular area 52*a* from the periphery of the low dielectric substrate 51 and exposes the bottom surface of the low dielectric substrate 51. Similarly, per FIG. 11B, a second feeder cutout portion 52*d* is formed in the electrode pattern 52B in such a manner that the second feeder cutout portion 52*d* reaches the circular area 52*b* from the periphery of the low dielectric substrate 51. The second feeder cutout portion 52*d*, per FIG. 11B, also exposes the bottom surface of the low dielectric substrate 51, and is formed parallel to the first feeder cutout portion 52*c* in such a manner that the first feeder cutout portion 52*c* and the second feeder cutout portion 52*d* face each other.

Furthermore, per FIG. 11B, an input-side conductive pattern 52*e* composed of the same high-temperature superconductor as described above is formed in the first feeder cutout portion 52*c* and on the exposed bottom surface of the low dielectric substrate 51. Here, the input-side conductive pattern 52*e* and the first feeder cutout portion 52*c* form an input-side coplanar-type feeder line (hereinafter referred to as an "input-side feeder line"). Similarly, an output-side conductive pattern 52*f* composed of the same high-temperature superconductor as described above is formed in the second feeder cutout portion 52*d* and on the exposed bottom surface of the low dielectric substrate 51. Here, the output-side conductive pattern 52*f* and the second feeder cutout portion 52*d* form an output-side coplanar-type feeder line (hereinafter referred to as an "output-side feeder line").

In the resonator 50 illustrated in FIGS. 11A to 11C, resonators are formed in the resonator areas 51A and 51B. These resonators are connected with the connection electrode pattern 52C therebetween in the middle area 51C, and form a two-stage dual-mode resonator.

Figure 12:
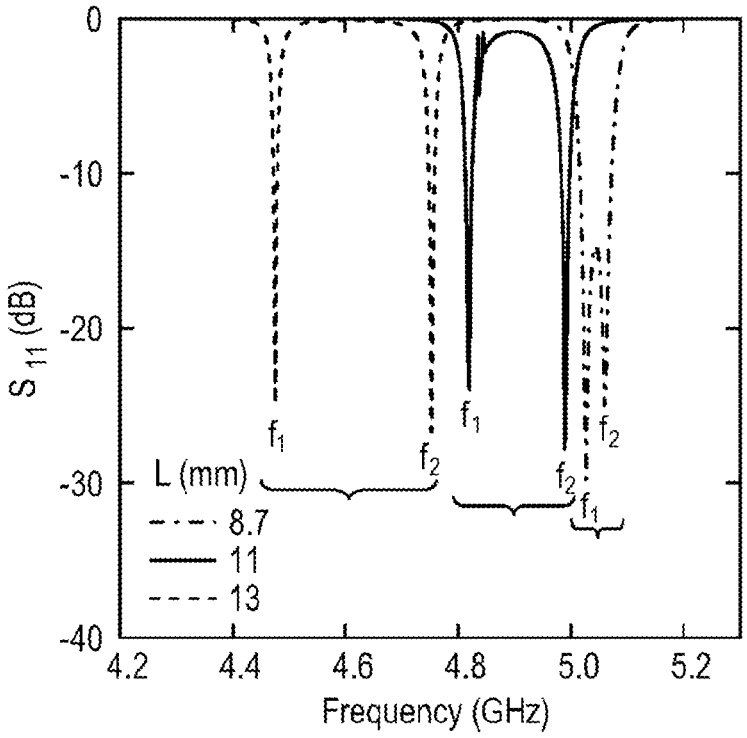
FIG. 12 is a diagram of a reflection characteristic of the superconducting resonator illustrated in FIGS. 11A to 11C.

FIG. 12 illustrates a reflection characteristic ($S_{11}$ parameter in dB) vs. Frequency in GHz of the resonator 50 where the disk-shaped electrode patterns 53A and 53B, each of which is an electrode pattern having a radius of 5.6 mm, are arranged on the low dielectric substrate 51. The distance between the centers of the disk-shaped electrode patterns 53A and 53B is 15.2 mm, the width W of the connection electrode pattern 52C is set to 4 mm, and the length L of the connection electrode pattern 52C is adjusted within the range of 8.7 mm to 11 mm to 13 mm.

Referring to FIG. 12, if the length L is short, that is, if the electrode patterns 52A and 52B are arranged close to each other with the cutout portions 51*a* and 51*b* therebetween, the resonance frequencies $f_1$, and $f_2$ become close to each other and the characteristics of the resonator 50 become similar to those of a single-mode filter. In contrast, if the length L increases, the resonance frequencies $f_1$ and $f_2$ become further away from each other and the characteristics of the resonator 50 become similar to those of a dual-mode filter. Moreover, if the length L increases, the resonance frequencies $f_1$ and $f_2$ are shifted and become lower.

Figure 13:
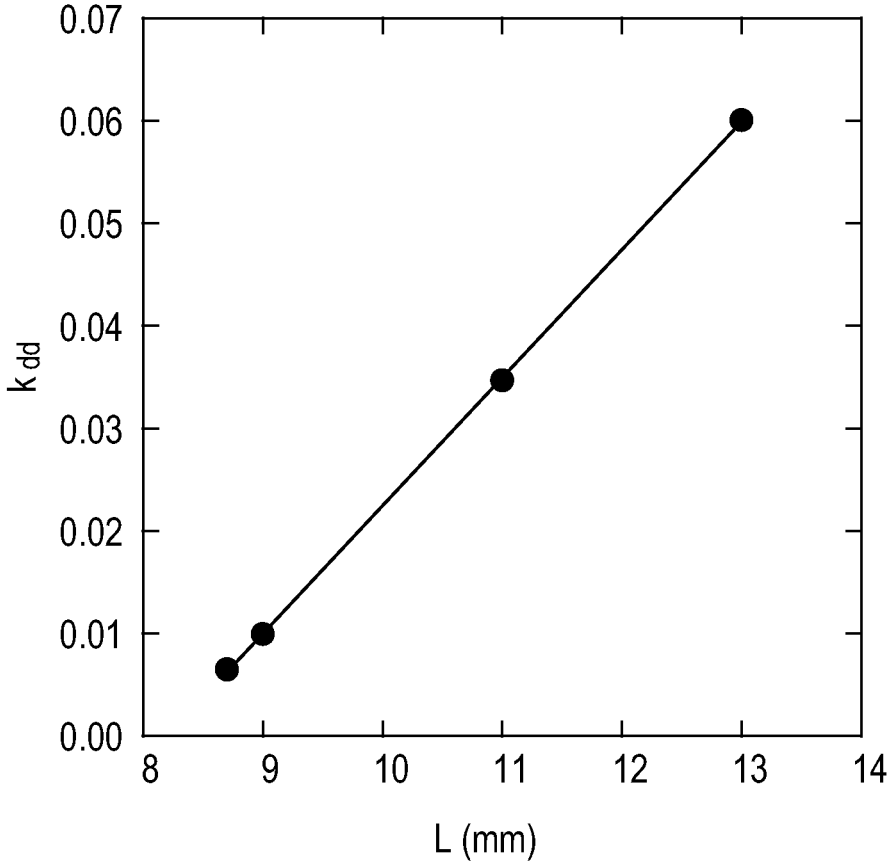
FIG. 13 is a diagram of an inter-resonator coupling coefficient of the superconducting resonator illustrated in FIGS. 11A to 11C.

FIG. 13 illustrates a relationship between an inter-resonator coupling coefficient $k_{dd}$ and the length L in mm. The inter-resonator coupling coefficient $k_{dd}$ is obtained using the resonance frequencies $f_1$ and $f_2$ in FIG. 12. Here, the inter-resonator coupling coefficient $k_{dd}$ is expressed by the expression $$k_{dd}=(f_{22}-f_{12})/(f_{22}+f_{12})(f_2>f_1).$$

Referring to FIG. 13, the inter-resonator coupling coefficient $k_{dd}$ changes almost linearly as the length L changes.

In the fourth embodiment, the input-side feeder line including the first feeder cutout portion 52*c* and the input-side conductive pattern 52*e* and the output-side feeder line including the second feeder cutout portion 52*d* and the output-side conductive pattern 52*f* are formed in the electrode patterns 52A and 52B so as to reach the circular areas 52*a* and 52*b*, respectively, the electrode patterns 52A and 52B being continuous on the back-side surface of the low dielectric substrate 51. As a result, according to the fourth embodiment, a capacitance obtained between the input-side conductive pattern 52*e* and the electrode pattern 52A and a capacitance obtained between the output-side conductive pattern 52*f* and the electrode pattern 52B increase, whereby strong coupling may be achieved. That is, according to the fourth embodiment, loss caused by using the resonator 50 or loss caused by using a filter using the resonator 50 may be reduced more significantly than when feeder lines are formed on the front-side surface of the low dielectric substrate 51.

In the fourth embodiment, the low dielectric substrate 51 is not limited to a MgO single crystal substrate and may alternatively be a $LaAlO_3$ single crystal substrate or a sapphire substrate.

Furthermore, the electrode patterns 52A and 52B, the connection electrode pattern 52C, the disk-shaped electrode patterns 53A and 53B, and the input-side and output-side conductive patterns 52*e* and 52*f* may alternatively be composed of, for example, an R—Ba—Cu—O (RBCO) high-temperature superconductor film, that is, a film composed of neodymium (Nd), samarium (Sm), gadolinium (Gd), dysprosium (Dy), and holmium (Ho) instead of yttrium (Y) in the YBCO high-temperature superconductor.

Furthermore, in the fourth embodiment, Ba—Sr—Ca—Cu—O (BSCCO), Pb—Bi—Sr—Ca—Cu—O (PBSCCO), and Cu—$Ba_p$—$Ca_q$—$Cu_r$—Ox (CBCCO) (where 1.5<p<2.5, 2.5<q<3.5, 3.5<r<4.5) high-temperature superconductors may alternatively be used.

Here, in the resonator 50 according to the fourth embodiment, the electrode patterns 52A and 52B, the connection electrode pattern 52C, the disk-shaped electrode patterns 53A and 53B, the input-side conductive pattern 52*e*, and the output-side conductive pattern 52*f* may not be composed of a high-temperature superconductor, and may alternatively be composed of a normal conductor.

The resonator 50 illustrated in FIGS. 11A to 11C may also be used as a filter.

Fifth Embodiment

Figure 14:
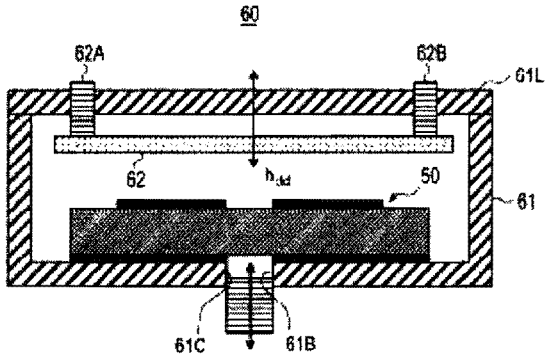
FIG. 14 is a sectional view of a superconducting filter according to a fifth embodiment.

FIG. 14 illustrates a superconducting filter 60 according to the fifth embodiment.

Referring to FIG. 14, a superconducting filter 60 includes a package container 61 that carries a wiring pattern (not shown) formed as a microstrip line on the bottom portion of the package container 61. The resonator 50 may be mounted on the bottom portion of the package container 61 by a flip-chip method. Moreover, an opening 61B corresponding to a center portion of the connection electrode pattern 52C of FIG. 11C is formed in the bottom portion of the package container 61.

Furthermore, a dielectric plate 62 composed of MgO, sapphire, or the like is arranged above the resonator 50 in the package container 61. The dielectric plate 62 is held by a cover 61L of the package container 61 using a screw 62B and the like in such a manner that the dielectric plate 62 may be adjusted to be closer to or further away from the resonator 50. The distance between the dielectric plate 62 and the resonator 50 is in the range of 0.01 mm to 10 mm.

Furthermore, in the superconducting filter 60, a rod 61C corresponding to the ground slot 22B and having a screw shape is formed in the opening 61B of the superconducting filter 60 in such a manner that the rod 61C may be adjusted to be closer to or further away from the connection electrode pattern 52C. The distance $h_{dd}$ between the rod 61C and the connection electrode pattern 52C is in the range of 0.0 mm to 0.7 mm.

Figure 15A:
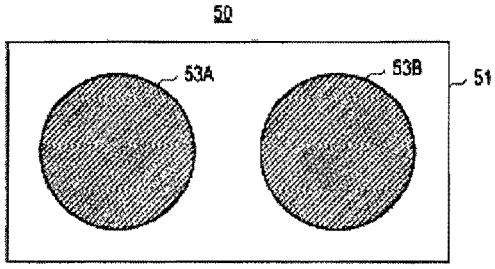
FIG. 15A is a plan view of a superconducting resonator used in the superconducting filter illustrated in FIG. 14.
Figure 15B:
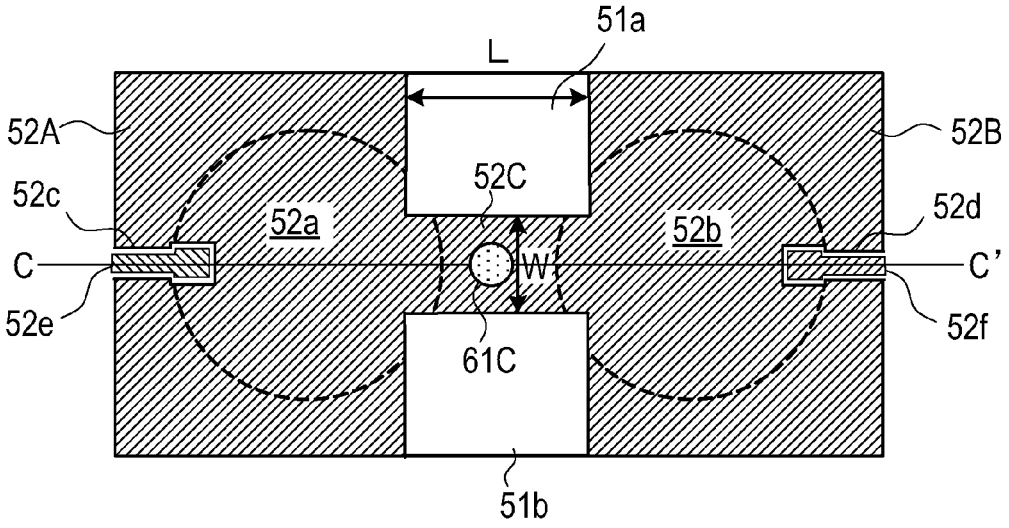
FIG. 15B is a bottom view of the superconducting resonator used in the superconducting filter illustrated in FIG. 14.
Figure 15C:
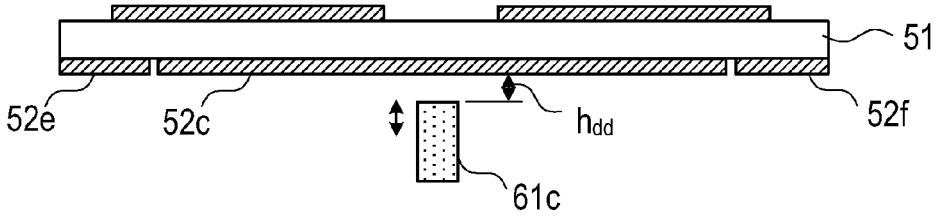
FIG. 15C is a sectional view of the superconducting resonator used in the superconducting filter illustrated in FIG. 14, the sectional view being taken along line C-C' in FIG. 15B.

FIGS. 15A to 15C illustrate a plan view, a bottom view, and a sectional view taken along line C-C' in FIG. 15B, respectively, of the resonator 50 in the package container 61. Here, in FIGS. 15A to 15C, components the same as those indicated above will be denoted by the same reference numerals and description thereof will be omitted.

As illustrated in FIG. 15B, the rod 61C is provided in the center of the connection electrode pattern 52C. In the fifth embodiment, by providing the rod 61C in such a manner that the rod 61C may be adjusted to be closer to or further away from the connection electrode pattern 52C, the inter-resonator coupling coefficient $k_{dd}$ is controlled using the distance $h_{dd}$, whereby the passband characteristic of the superconducting filter 60 may be controlled per FIG. 15C.

Figure 16:
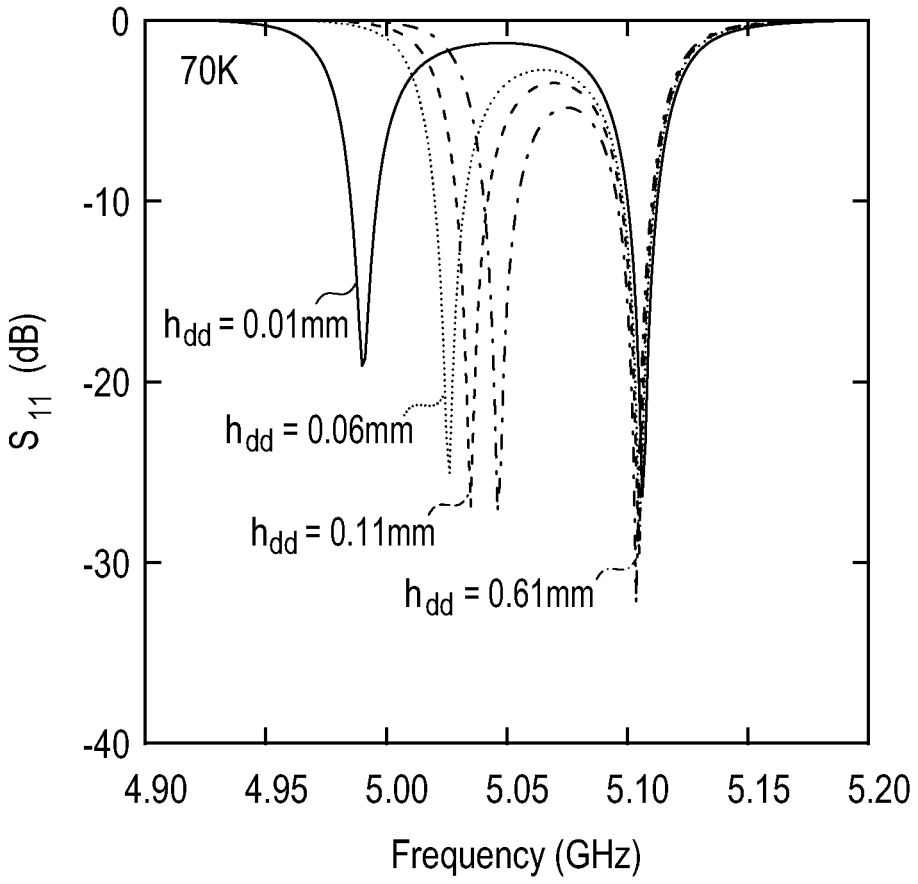
FIG. 16 is a diagram of a reflection characteristic of the superconducting filter illustrated in FIG. 14.
Figure 17:
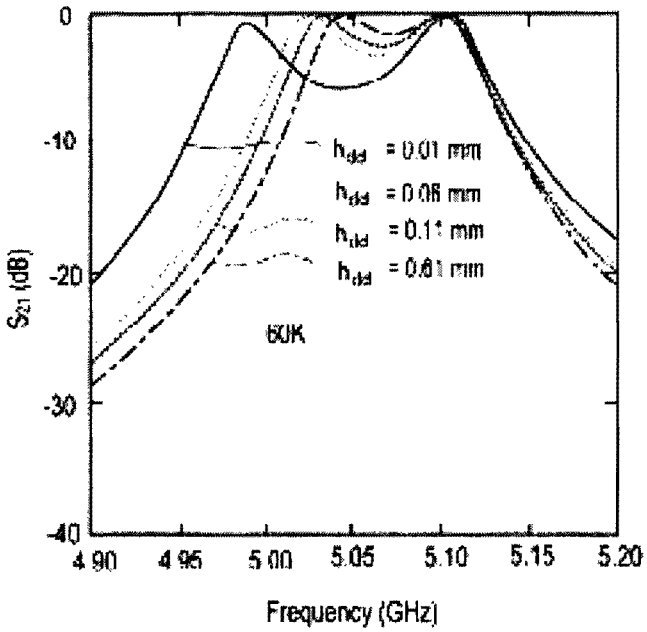
FIG. 17 is a diagram of a transmission characteristic of the superconducting filter illustrated in FIG. 14.

FIG. 16 illustrates a reflection characteristic (S11 in dB) vs. Frequency in GHz of the superconducting filter 60 at a temperature of 70 K with $S_{11}$(dB) in the y-axis and Frequency (GHz) in the x-axis, and FIG. 17 illustrates the passband characteristic $S_{21}$ in dB vs. Frequency in Ghz of the superconducting filter 60 in cases where $h_{dd}$=0.01 mm, $h_{dd}$=0.06 mm, $h_{dd}$=0.11 mm, and $h_{dd}$=0.61 mm at a temperature of 60K with $S_{21}$(dB) in the y-axis and Frequency (GHz) in the x-axis. In FIG. 16, the length L is set to 27 mm and the width W is set to, for example, 4 mm. In the example in FIG. 16, a metal screw having a radius of 2 mm is used as the rod 61C. Here, the rod 61C may be composed of a magnetic material or a dielectric material such as MgO, $LaAlO_3$, $TiO_2$, or the like.

As may be seen from FIGS. 16 and 17, the passband width of the superconducting filter 60 decreases as the distance $h_{dd}$ becomes larger and increases as the distance $h_{dd}$ becomes smaller. Moreover, FIGS. 16 and 17 illustrate that if the distance $h_{dd}$ is changed by the rod 61C, the center frequency of the superconducting filter 60 changes If the distance $h_{dd}$ decreases, the center frequency thereof is shifted and becomes higher. If the distance $h_{dd}$ increases, the center frequency thereof is shifted and becomes lower. However, such a shift regarding the center frequency thereof may be compensated by changing the distance between the dielectric plate 62 and the resonator 50 using the screw 62B.

Figure 18:
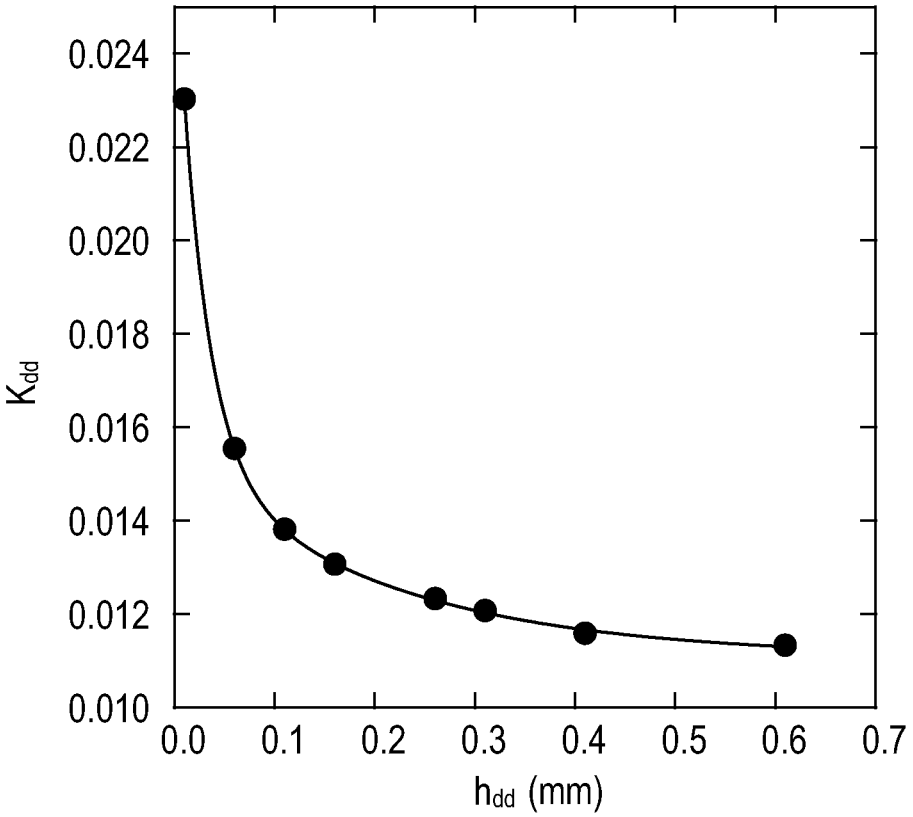
FIG. 18 is a diagram of an inter-resonator coupling coefficient of the superconducting filter illustrated in FIG. 14.

FIG. 18 illustrates a relationship between the inter-resonator coupling coefficient $k_{dd}$ and the distance $h_{dd}$ in mm for the superconducting filter 60. The inter-resonator coupling coefficient $k_{dd}$ is obtained at a temperature of 60 K from the reflection characteristic illustrated in FIG. 16.

Referring to FIG. 18, if the distance $h_{dd}$ decreases, the inter-resonator coupling coefficient $k_{dd}$ steeply increases, whereby the passband width decreases. In contrast, if the distance $h_{slot}$ increases, the effect of the ground slot 22B increases, whereby the passband width increases as illustrated in FIGS. 8 and 9.

In the fifth embodiment, the input-side feeder line including the first feeder cutout portion 52*c* and the input-side conductive pattern 52*e* and the output-side feeder line including the second feeder cutout portion 52*d* and the output-side conductive pattern 52*f* are formed in the electrode patterns 52A and 52B so as to reach the circular areas 52*a* and 52*b*, respectively. The electrode patterns 52A and 52B are continuous on the back-side surface of the low dielectric substrate 51. As a result, according to the fifth embodiment, a capacitance obtained between the input-side conductive pattern 52*e* and the electrode pattern 52A and a capacitance obtained between the output-side conductive pattern 52*f* and the electrode pattern 52B increase, whereby strong coupling may be achieved. That is, according to the fifth embodiment, loss caused by using the superconducting filter 60 may be reduced more significantly than when feeder lines are formed on the front-side surface of the low dielectric substrate 51.

In the fifth embodiment, a steep passband characteristic may be achieved by coupling two resonators as illustrated in FIG. 17. Here, in the fifth embodiment, the number of resonators being coupled to each other is not limited to two. Three or more resonators may alternatively be coupled to each other.

In the superconducting filter 60, the dielectric plate 62 and the screws 62A and 62B may also be omitted.

Sixth Embodiment

Figure 19A:
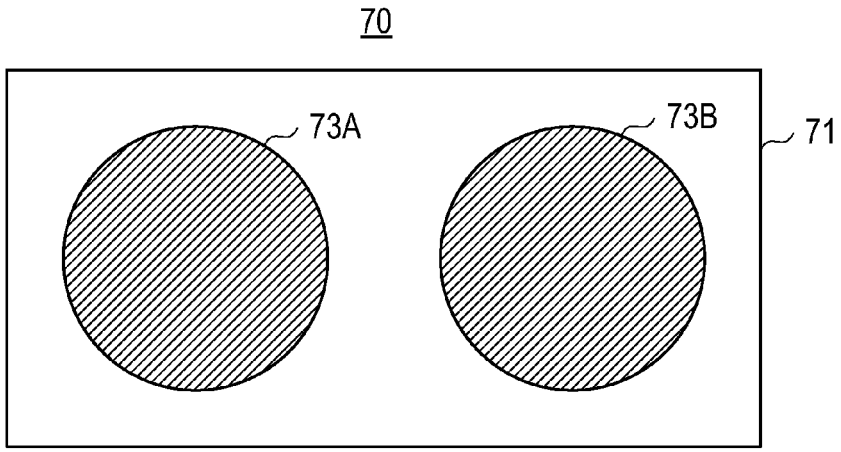
FIG. 19A is a plan view of a superconducting resonator according to a sixth embodiment.
Figure 19B:
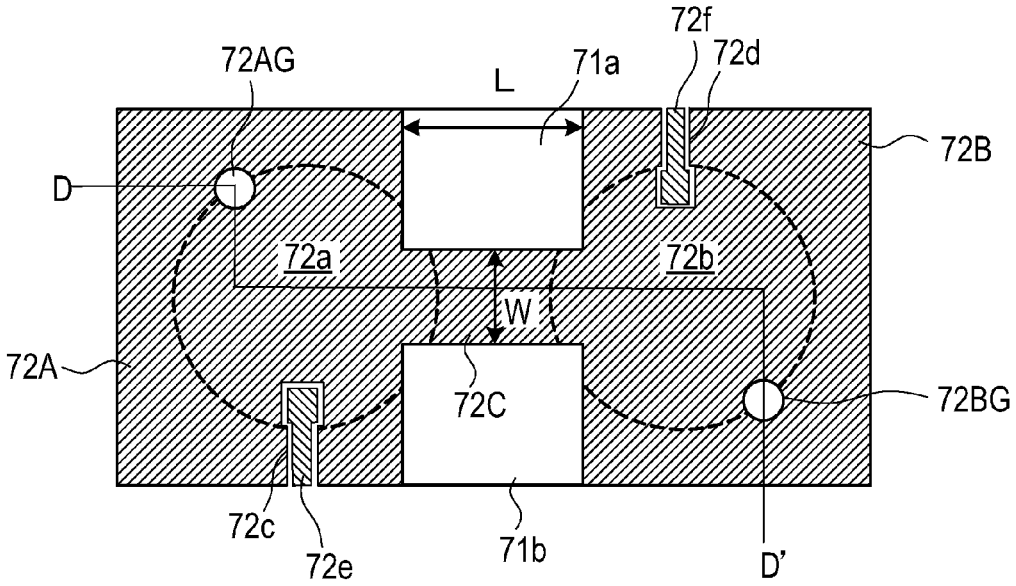
FIG. 19B is a bottom view of the superconducting resonator according to the sixth embodiment.
Figure 19C:
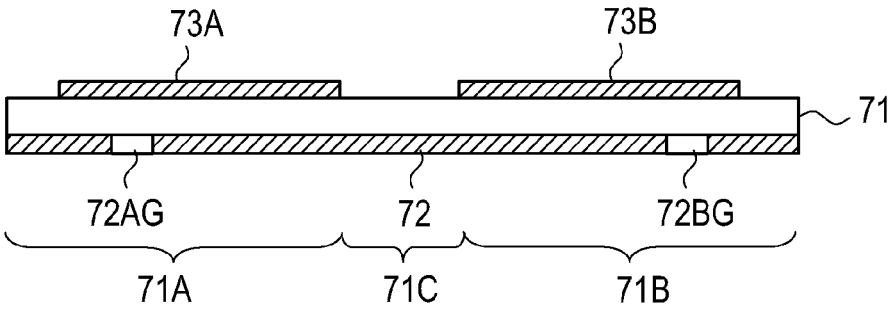
FIG. 19C is a sectional view of the superconducting resonator according to the sixth embodiment, the sectional view being taken along line D-D' in FIG. 19B.

FIG. 19A is a plan view, FIG. 19B is a bottom view, and FIG. 19C is a sectional view taken along line D-D' in FIG. 19B of a resonator according to a sixth embodiment.

Referring to FIG. 19A, the resonator 70 is formed on a low-loss dielectric substrate 71 having a thickness of 0.5 mm and composed of MgO or the like, for example. Per FIG. 19C, resonator areas 71A and 71B are formed on the low-loss dielectric substrate 71 and spaced apart by a middle area 71C.

An electrode pattern 72A having a thickness of, for example, 0.5 μm composed of, for example, a YBCO (Y—Ba—Cu—O) high-temperature superconductor is formed on the bottom surface of the low-loss dielectric substrate 71 so as to cover the resonator area 71A. Furthermore, an electrode pattern 72B composed of a similar high-temperature superconductor is formed on the bottom surface of the low-loss dielectric substrate 71 so as to cover the resonator area 71B.

Furthermore, per FIG. 19B, the central portions of the electrode patterns 72A and 72B are connected to each other in the middle area 71C on the bottom surface of the low-loss dielectric substrate 71. A connection electrode pattern 72C composed of a similar high-temperature superconductor is formed having a width W and a length L. The electrode patterns 72A and 72B and the connection electrode pattern 72C are formed by forming cutout portions 71*a* and 71*b* in the middle area 71C on a high-temperature conductor film that uniformly covers the bottom surface of the low-loss dielectric substrate 71. The cutout portions 71*a* and 71*b* extend from sides of the high-temperature conductor film toward a virtual center line connecting the resonator areas 71A and 71B.

FIGS. 19A & 19C, a disk-shaped electrode pattern 73A composed of the same high-temperature superconductor as described above and having a thickness of 0.5 μm and a radius of 5.6 mm is formed in the resonator area 71A on the top surface of the low-loss dielectric substrate 71 in such a manner that the disk-shaped electrode pattern 73A and a circular area 72*a* hold the low-loss dielectric substrate 71 therebetween. The circular area 72*a* per FIG. 19B, is a part of the electrode pattern 72A. Similarly, per FIGS. 19A & 19C, a disk-shaped electrode pattern 73B composed of the same high-temperature superconductor as described above and having, for example, a thickness of 0.5 μm and a radius of 5.6 mm is formed in the resonator area 71B on the top surface of the low-loss dielectric substrate 71 in such a manner that the disk-shaped electrode pattern 73B and a circular area 72*b* per FIG. 19B hold the low-loss dielectric substrate 71 therebetween. The circular area 72*b* per FIG. 19B is a part of the electrode pattern 72B.

Per FIG. 19B, a first feeder cutout portion 72*c* is formed in the electrode pattern 72A on the bottom surface of the low-loss dielectric substrate 71 in such a manner that the first feeder cutout portion 72*c* reaches the circular area 72*a* from the periphery of the low-loss dielectric substrate 71 and exposes the bottom surface of the low-loss dielectric substrate 71. Similarly, a second feeder cutout portion 72*d* is formed in the electrode pattern 72B in such a manner that the second feeder cutout portion 72*d* reaches the circular area 72*b* from the periphery of the low-loss dielectric substrate 71. The second feeder cutout portion 72*d* also exposes the bottom surface of the low-loss dielectric substrate 71. The second feeder cutout portion 72*d* is formed parallel to the first feeder cutout portion 72*c* and perpendicular to an imaginary line that connects the centers of the circular areas 72*a* and 72*b*.

In the electrode pattern 72A, a circular ground slot 72AG, per FIGS. 19B and 19C, similar to the ground slot 22B illustrated in FIG. 2B is formed in a part of the circular area 72*a* at a position away from the center of the circular area 72*a*. Similarly, in the electrode pattern 72B, a circular ground slot 72BG, per FIGS. 19B and 19C, similar to the circular ground slot 72AG is formed in part of the circular area 72*b* at a position away from the center of the circular area 72*b*.

Furthermore, per FIG. 19B, an input-side conductive pattern 72*e* composed of the same high-temperature superconductor as described above is formed in the first feeder cutout portion 72*c* and on the exposed bottom surface of the low-loss dielectric substrate 71. Here, the input-side conductive pattern 72*e* and the first feeder cutout portion 72*c* form an input-side coplanar-type feeder line (hereinafter referred to as an "input-side feeder line"). Similarly, an output-side conductive pattern 72*f* composed of the same high-temperature superconductor as described above is formed in the second feeder cutout portion 72*d* and on the exposed bottom surface of the low-loss dielectric substrate 71. Here, the output-side conductive pattern 72*f* and the second feeder cutout portion 72*d* form an output-side coplanar-type feeder line (hereinafter referred to as an "output-side feeder line").

In the resonator 70 illustrated in FIGS. 19A to 19C, resonators are formed in the resonator areas 71A and 71B. These resonators are connected to each other via the connection electrode pattern 72C in the middle area 71C per FIG. 19C, and form a two-stage dual-mode resonator.

Figure 20:
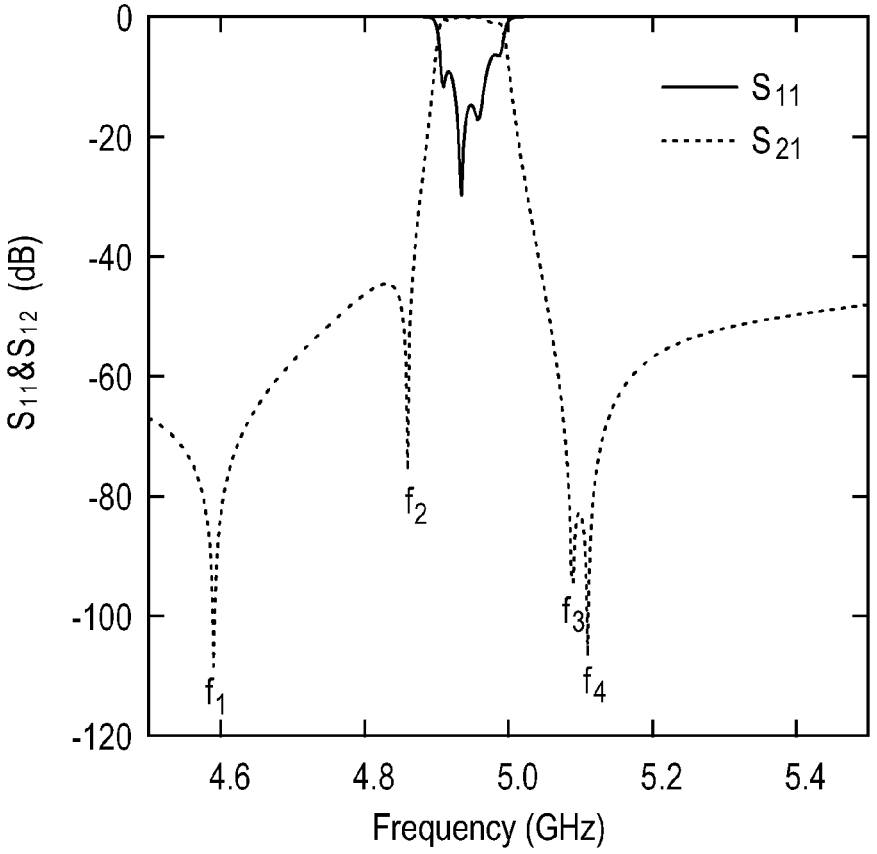
FIG. 20 is a diagram of a reflection characteristic of the superconducting filter illustrated in FIGS. 19A to 19C.

FIG. 20 illustrates a reflection characteristic ($S_{11}$ parameter in dB) and a transmission characteristic ($S_{21}$ parameter in dB, respectively) vs. Frequency in GHz of the resonator 70 in a case where the disk-shaped electrode patterns 73A and 73B, each of which is an electrode pattern having a radius of 5.6 mm, are arranged on the low-loss dielectric substrate 71 per FIGS. 19A to 19C detailed above. The distance between the centers of the disk-shaped electrode patterns 73A and 73B may be, for example, 15.2 mm, the width W of the connection electrode pattern 72C is set to 4 mm, the length L of the connection electrode pattern 72C is set to, for example, 8.7 mm, and the radii of the circular ground slots 72AG and 72BG are set to, for example, 0.97 mm.

As may be seen from FIG. 20, as a transmission characteristic, resonance frequencies $f_1$, $f_2$, $f_3$, and $f_4$ are obtained for the two-stage dual mode resonator, that is, a four-stage resonator, and a passband is formed between the resonance frequencies $f_2$ and $f_3$. In an example in FIG. 20, a bandwidth of −3 dB indicates 87 MHz, and steepness indicates −30 dB/(26 to 29 MHz).

In the sixth embodiment, the input-side feeder line including the first feeder cutout portion 72*c* and the input-side conductive pattern 72*e* and the output-side feeder line including the second feeder cutout portion 72*d* and the output-side conductive pattern 72*f* are formed in the electrode patterns 72A and 72B so as to reach the circular areas 72*a* and 72*b*, respectively. The electrode patterns 72A and 72B are continuous on the back-side surface of the low-loss dielectric substrate 71. As a result, according to the sixth embodiment, a capacitance obtained between the input-side conductive pattern 72*e* and the electrode pattern 72A and a capacitance obtained between the output-side conductive pattern 72*f* and the electrode pattern 72B increase, whereby strong coupling may be achieved. That is, according to the sixth embodiment, loss caused by using the resonator 70 or loss caused by a filter using the resonator 70 may be more significantly reduced than when feeder lines are formed on the front-side surface of the low-loss dielectric substrate 71.

Here, in the sixth embodiment, the low-loss dielectric substrate 71 is not limited to a MgO single crystal substrate and may alternatively be a $LaAlO_3$ single crystal substrate or a sapphire substrate.

Furthermore, the electrode patterns 72A and 72B, the connection electrode pattern 72C, the disk-shaped electrode patterns 73A and 73B, and the input-side and output-side conductive patterns 72*e* and 72*f* may not be composed of the YBCO high-temperature superconductor and may alternatively be composed of, for example, R—Ba—Cu—O (RBCO) high-temperature superconductor film, that is, a film composed of neodymium (Nd), samarium (Sm), gadolinium (Gd), dysprosium (Dy), and holmium (Ho) instead of yttrium (Y) in the YBCO high-temperature superconductor.

Furthermore, in the sixth embodiment, Ba—Sr—Ca—Cu—O (BSCCO), Pb—Bi—Sr—Ca—Cu—O (PBSCCO), and Cu—$Ba_p$—$Ca_q$—$Cu_r$—Ox (CBCCO) (where $1.5<p<2.5$, $2.5<q<3.5$, $3.5<r<4.5$) high-temperature superconductors may alternatively be used.

In the sixth embodiment, the intensity of an electric field may be reduced or prevented from being high and a problem of an electrode layer 72 losing superconductivity because of an intense electric field may be prevented by forming the circular ground slots 72AG and 72BG in a circular shape.

In the resonator 70 according to the sixth embodiment, the electrode patterns 72A and 72B, the connection electrode pattern 72C, the disk-shaped electrode patterns 73A and 73B, the input-side conductive pattern 72*e*, and the output-side conductive pattern 72*f* may not be composed of a high-temperature superconductor, and may alternatively be composed of a normal conductor.

In the sixth embodiment, a steep passband characteristic as illustrated in FIG. 17 may be achieved by coupling two dual-mode resonators. Here, in the sixth embodiment, the number of dual-mode resonators being coupled to each other is not limited to two. Three or more dual-mode resonators may alternatively be coupled to each other.

The resonator 70 illustrated in FIGS. 19A to 19C may also be used as a filter.

Seventh Embodiment

Figure 21:
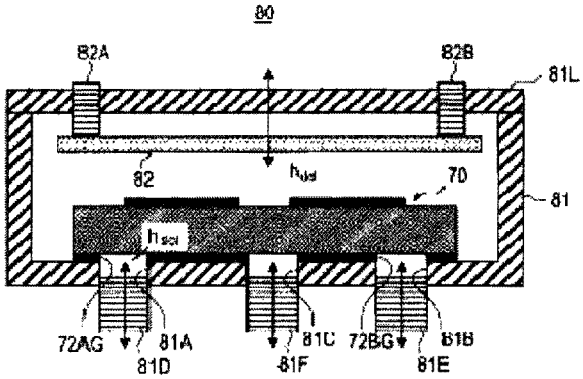
FIG. 21 is a sectional view of a superconducting filter according to a seventh embodiment.

FIG. 21 illustrates a superconducting filter 80 according to the seventh embodiment.

Referring to FIG. 21, the superconducting filter 80 includes a package container 81 that carries a wiring pattern (not shown) formed as a microstrip line on the bottom portion of the package container 81, and the resonator 70 is mounted on the bottom portion of the package container 81 by a flip-chip method. Moreover, openings 81A and 81B corresponding to the circular ground slots 72AG and 72BG and an opening 81C corresponding to a center portion of the connection electrode pattern 72C, per FIG. 22B, are formed on the bottom portion of the package container 81.

Furthermore, a dielectric plate 82 composed of MgO, sapphire, or the like is arranged above the resonator 70 in the package container 81. The dielectric plate 82 is held by a cover 81L of the package container 81 using screws 82A and 82B and the like in such a manner that the dielectric plate 82 may be adjusted to be closer to or further away from the resonator 70. The distance between the dielectric plate 82 and the resonator 70 may be adjusted to be in the range of 0.01 mm to 10 mm.

Figure 22A:
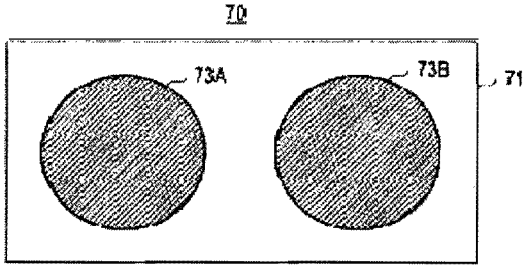
FIG. 22A is a plan view of a superconducting resonator used in the superconducting filter illustrated in FIG. 21.
Figure 22B:
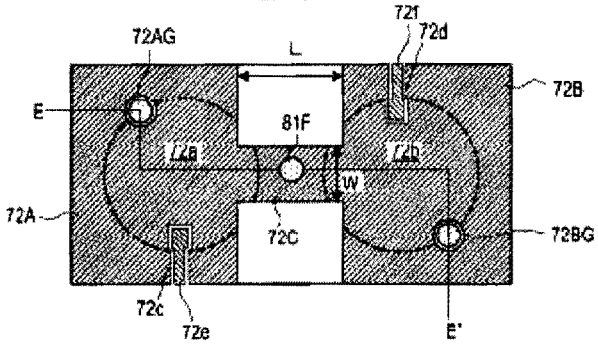
FIG. 22B is a bottom view of the superconducting resonator used in the superconducting filter illustrated in FIG. 21.
Figure 22C:
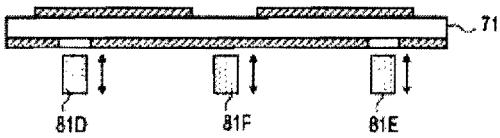
FIG. 22C is a sectional view of the superconducting resonator used in the superconducting filter illustrated in FIG. 21, the sectional view being taken along line E-E' in FIG. 22B.

Furthermore, rods 81D and 81E corresponding to the circular ground slots 72AG and 72BG and each having a screw shape are formed in the openings 81A and 81B of the superconducting filter 80, respectively, in such a manner that the rods 81D and 81E may be adjusted to be closer to or further away from the low-loss dielectric substrate 71 as shown in FIG. 22C. The distance $h_{slot}$ between the rod 81D and the low-loss dielectric substrate 71 and the distance $h_{slot}$ between the rod 81E and the low-loss dielectric substrate 71 may be in the range of 0.01 mm to 1 mm. Moreover, the opening 81C corresponding to the center portion of the connection electrode pattern 72C is formed on the bottom portion of the package container 81, and a rod 81F is held in the opening 81C in such a manner that the rod 81F may be adjusted to be closer to or further away from the connection electrode pattern 72C. The distance $h_{dd}$ between the rod 81F and the connection electrode pattern 72C may be in the range of 0.0 mm to 0.7 mm. Here, the rods 81D to 81F may be composed of a magnetic material or a dielectric material such as MgO, $LaAlO_3$, $TiO_2$, or the like.

FIGS. 22A to 22C are a plan view, a bottom view, and a sectional view taken along line E-E' in FIG. 22B, respectively, of the resonator 70 in the package container 81. In FIGS. 22A to 22C, components the same as those indicated above will be denoted by the same reference numerals and description thereof will be omitted. The sectional view in FIG. 21 is actually a sectional view taken along line E-E'.

As illustrated in FIG. 22B, similarly to the rod 61C illustrated in FIG. 15B, the rod 81F is provided in the center of the connection electrode pattern 72C. In the seventh embodiment, by providing the rod 81F in such a manner that the rod 81F may be adjusted to be closer to or further away from the connection electrode pattern 72C, the inter-resonator coupling coefficient $k_{dd}$ is controlled using the distance $h_{dd}$ (e.g. as shown in FIG. 21), whereby the passband characteristic of the superconducting filter 80 is controlled. Moreover, by providing the rods 81D and 81E in such a manner that the rods 81D and 81E may be adjusted to be closer to or further away from the low-loss dielectric substrate 71, the passband characteristic of the superconducting filter 80 may be controlled using the inter-resonator coupling coefficient $k_{dd}$.

In the superconducting filter 80, the dielectric plate 82 and the screws 82A and 82B may be omitted.

In the seventh embodiment, the input-side feeder line including the first feeder cutout portion 72*c* and the input-side conductive pattern 72*e* and the output-side feeder line including the second feeder cutout portion 72*d* and the output-side conductive pattern 72*f* are formed in the electrode patterns 72A and 72B so as to reach the circular areas 72*a* and 72*b*, respectively. The electrode patterns 72A and 72B are continuous on the back-side surface of the low-loss dielectric substrate 71. As a result, according to the seventh embodiment, a capacitance obtained between the input-side conductive pattern 72*e* and the electrode pattern 72A and a capacitance obtained between the output-side conductive pattern 72*f* and the electrode pattern 72B increase, whereby strong coupling may be achieved. That is, according to the seventh embodiment, the efficiency of the superconducting filter 80 using the resonator 70 may be improved more significantly than when feeder lines are formed on the front-side surface of the low-loss dielectric substrate 71.

Eighth Embodiment

Figure 23:
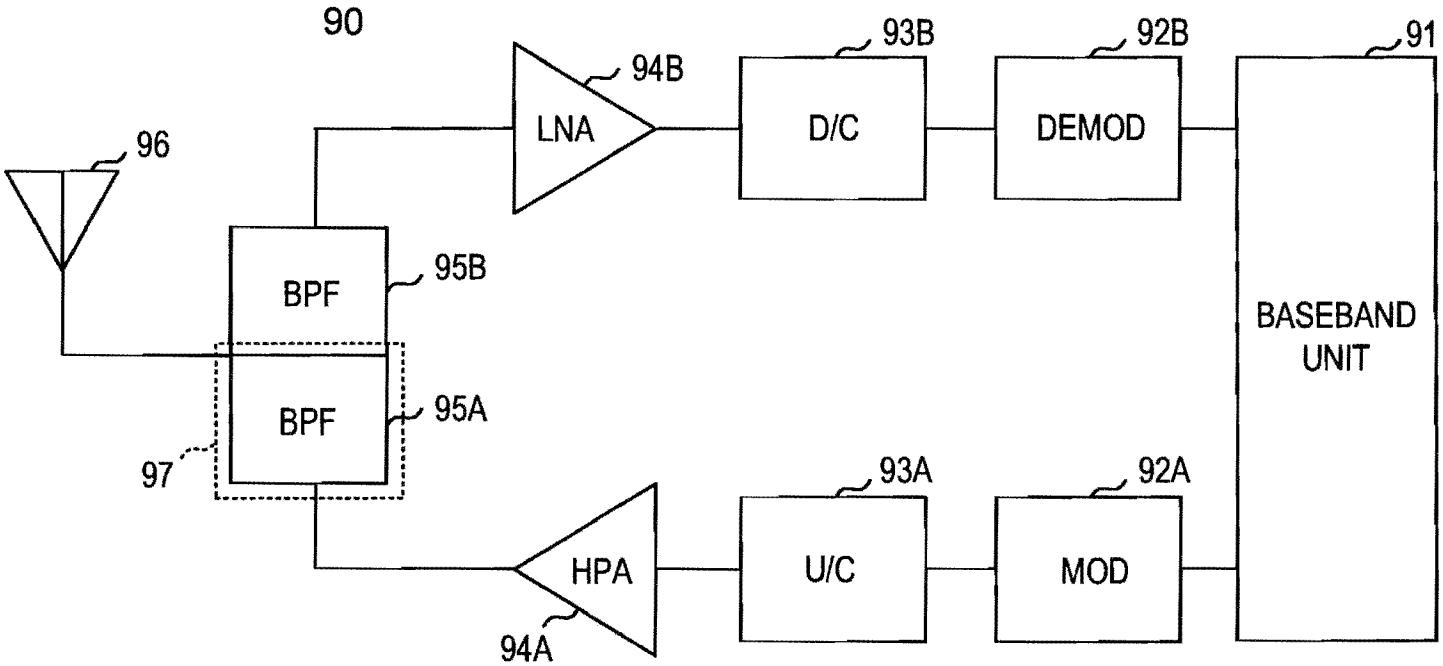
FIG. 23 is a block diagram of a transmitter-receiver according to an eighth embodiment.

FIG. 23 illustrates a schematic structure of a GHz-band transmitter-receiver 90 using a superconducting filter according to any one of the first to seventh embodiments.

Referring to FIG. 23, the GHz-band transmitter-receiver 90 includes a baseband unit 91 that includes an integrated circuit device. The baseband unit 91 generates a transmission signal, and the transmission signal is modulated by a modulator (MOD) 92A and the modulated signal is converted into a microwave signal by an up-converter (U/C) 93A. After the microwave signal is amplified by a power amplifier (HPA) 94A, the amplified signal is supplied to an antenna 96 via a superconducting filter (BPF) 95A according to any one of the first to seventh embodiments.

Moreover, the signal supplied to the antenna 96 is supplied to a low-noise amplifier (LNA) 94B through a superconducting filter (BPF) 95B. After the signal is amplified by the low-noise amplifier 94B, the amplified signal is converted into a high-frequency signal by a down-converter (D/C) 93B. After the high-frequency signal is demodulated by a demodulator (DEMOD) 92B, the demodulated signal is supplied to the baseband unit 91. Furthermore, a cryostat 97 is provided for cooling the superconducting filter 95A.

In the GHz-band transmitter-receiver 90 illustrated in FIG. 23, loss is small, operation may be efficiently performed, and power consumption may be reduced because the superconducting filter 95A has a superconducting electrode layer. Moreover, by using a high-temperature superconductor composed of an oxide as the superconducting electrode layer, superconductivity is maintained even in a liquid nitrogen temperature range of 60 to 80 K, whereby the power consumption of the cryostat 97 may be reduced.

The GHz-band transmitter-receiver 90 may be applied to, for example, base stations for mobile communication.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A filter comprising:

a dielectric substrate;

an electrode layer continuously formed covering a first side of the dielectric substrate;

a disk-shaped electrode pattern provided on a second side of the dielectric substrate, the disk-shaped electrode pattern and the electrode layer having the dielectric substrate therebetween;

a ground slot having an opening that is formed asymmetrically with respect to the center of a circular area included in the electrode layer and exposes the dielectric substrate, the circular area, and the disk-shaped electrode pattern having the dielectric substrate therebetween;

an input-side cutout portion that is formed in the electrode layer on the first side of the dielectric substrate so as to reach into the circular area and extends in a first direction;

an output-side cutout portion that is formed in the electrode layer on the first side of the dielectric substrate so as to reach into the circular area and extends in a second direction perpendicular to the first direction;

an input-side conductive pattern formed in the input-side cutout portion on the first side of the dielectric substrate so as to reach directly beneath the circular area and extends in the first direction beyond the circular area; a part of the input-side conductive pattern sandwich the dielectric substrate, and overlaps with the disk-shaped electrode pattern; and an output-side conductive pattern formed in the output-side cutout portion on the first side of the dielectric substrate so as to reach into the circular area and extends in the second direction, a part of the output-side conductive pattern sandwich the dielectric substrate, and overlaps with the disk-shaped electrode pattern.

2. The filter according to claim 1, wherein the input-side conductive pattern has a form that corresponds to a form of the input-side cutout portion, and the output-side conductive pattern has a form that corresponds to a form of the output-side cutout portion.

3. The filter according to claim 2, wherein the input-side cutout portion and the input-side conductive pattern form a first coplanar-type feeder line, and the output-side cutout portion and the output-side conductive pattern form a second coplanar-type feeder line.

4. The filter according to claim 1, wherein the ground slot has a circular opening.

5. The filter according to claim 1, further comprising:

an adjustment rod adjacent to the first side of the dielectric substrate, the adjustment rod being opposite the ground slot and being composed of a magnetic or dielectric material.

6. The filter according to claim 5, wherein the adjustment rod is held in such a manner that the adjustment rod is adjustable to be closer to or further away from the ground slot.

7. The filter according to claim 1, wherein the electrode layer, the electrode pattern, the input-side conductive pattern, and the output-side conductive pattern are composed of a superconductor.

* * * * *